US007997910B2

(12) United States Patent
Myers et al.

(10) Patent No.: US 7,997,910 B2
(45) Date of Patent: Aug. 16, 2011

(54) CONNECTORS FOR ELECTRICALLY ACTIVE GRID

(75) Inventors: Jere W. Myers, Washington Boro, PA (US); Brian T. Patterson, Lewisberry, PA (US); Jae A. Eisenhower, West Chester, PA (US); Randy M Manning, Lemoyne, PA (US); Charles E. Reynolds, Mechanicsburg, PA (US); William J. Garver, Harrisburg, PA (US); Jon A. Fortuna, Mechanicsburg, PA (US); Ronald P. Locati, York, PA (US)

(73) Assignee: AWI Licensing Company, Wilmington, DE (US)

( * ) Notice: Subject to any disclaimer, the term of this patent is extended or adjusted under 35 U.S.C. 154(b) by 23 days.

(21) Appl. No.: 12/386,215

(22) Filed: Apr. 15, 2009

(65) Prior Publication Data

US 2010/0015854 A1 Jan. 21, 2010

Related U.S. Application Data

(60) Provisional application No. 61/124,226, filed on Apr. 15, 2008.

(51) Int. Cl.
*H01R 25/00* (2006.01)

(52) U.S. Cl. ..... 439/121

(58) Field of Classification Search ..... 439/121–123, 439/533
See application file for complete search history.

(56) References Cited

U.S. PATENT DOCUMENTS

| | | | | |
|---|---|---|---|---|
| 3,725,568 | A * | 4/1973 | Stanley | 174/491 |
| 4,540,847 | A * | 9/1985 | Gardner | 174/491 |
| 5,412,529 | A * | 5/1995 | Eaton et al. | 439/215 |
| 5,455,754 | A * | 10/1995 | Hoffner | 362/249.07 |
| 6,040,525 | A * | 3/2000 | Chauquet et al. | 439/112 |
| 6,059,582 | A * | 5/2000 | Tsai | 439/121 |
| 6,483,025 | B1 * | 11/2002 | Samsi et al. | 174/480 |
| 6,722,918 | B2 * | 4/2004 | McCoy | 439/121 |
| 7,198,513 | B2 | 4/2007 | Marchese | |
| 7,351,075 | B1 | 4/2008 | Patterson et al. | |
| 7,374,057 | B2 * | 5/2008 | Hendrickson et al. | 220/3.8 |
| 7,661,229 | B2 * | 2/2010 | Frecska et al. | 174/491 |
| 2007/0153550 | A1 | 7/2007 | Lehman et al. | |
| 2007/0161270 | A1 | 7/2007 | Insalaco et al. | |

FOREIGN PATENT DOCUMENTS

WO 2006/015311 A2 2/2006

* cited by examiner

*Primary Examiner* — Briggitte R Hammond

(57) ABSTRACT

The invention includes an electrified framework system having a plurality of grid members which form a grid framework. A conductive material is disposed on a surface of at least one of the plurality of grid members as shown throughout the drawings. The system includes connectors which provide low voltage power connections. For example, the connectors bring power from a power supply to the conductive material disposed on the grid framework and/or the connectors provide electrical connections between the conductive material on the grid framework and various devices.

40 Claims, 22 Drawing Sheets

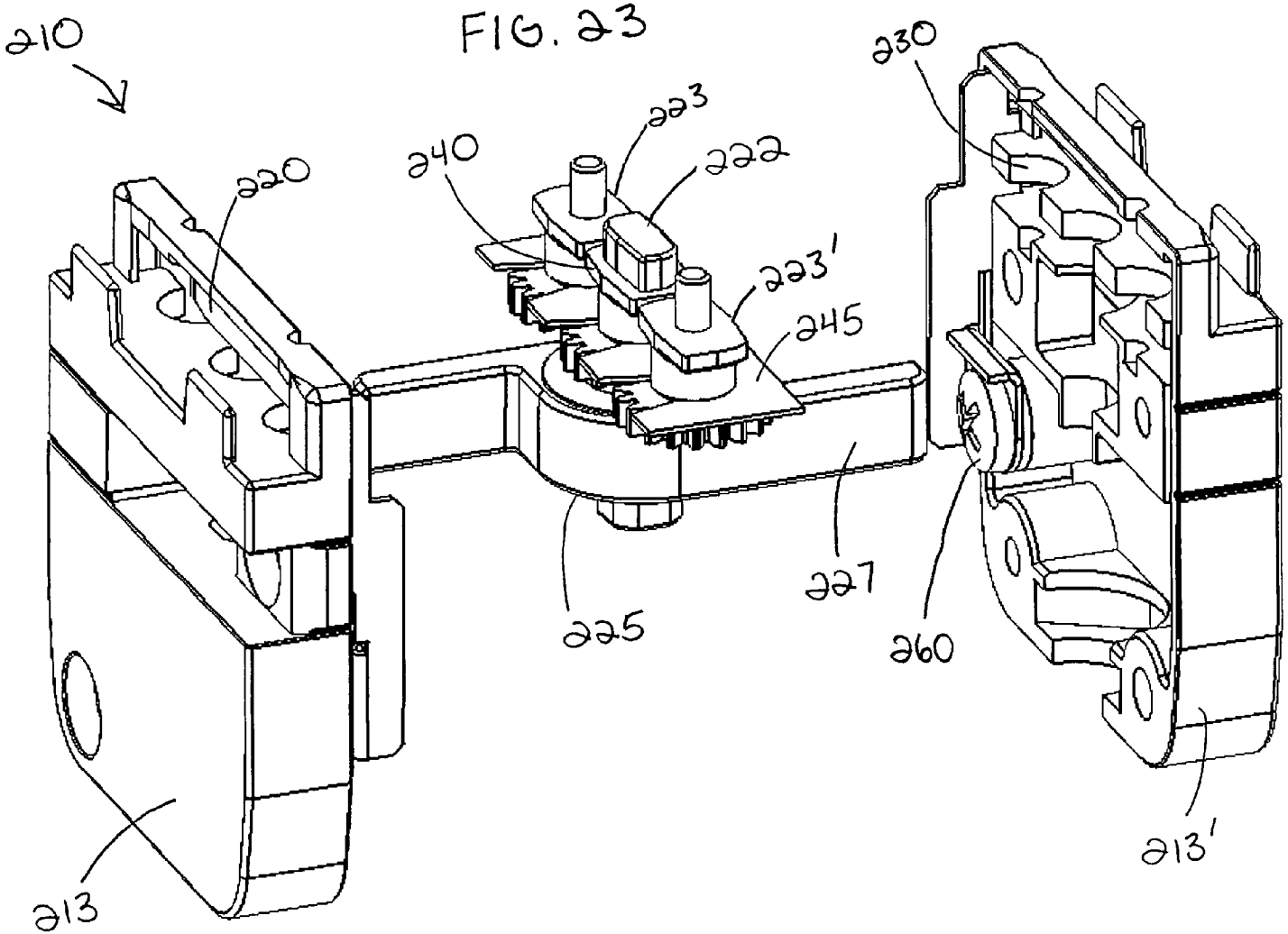
210
230
240
260
250
270
280
290
300
310
320
330
340
350
360
370
380
390
400
410
420
430
440
450
460
470
480
490
500
510
520
530
540
550
560
570
580
590
600
610
620
630
640
650
660

CONNECTORS FOR ELECTRICALLY ACTIVE GRID

CROSS REFERENCE TO RELATED APPLICATION

This application claims the benefit under 35 U.S.C. §119 (e) of U.S. provisional application Ser. No. 61/124,226, filed Apr. 15, 2008.

FIELD OF THE INVENTION

The present invention is directed to connectors, and, more particularly, to connectors for making low voltage direct current electrical connections between conductive elements.

The electrical grid connecting America's power plants, transmission lines and substations to homes, businesses and factories operate almost entirely within the realm of high voltage alternating current (AC). Yet, an increasing fraction of devices found in those buildings actually operate on low voltage direct current (DC). Those devices include, but are not limited to, digital displays, remote controls, touch-sensitive controls, transmitters, receivers, timers, light emitting diodes (LEDs), audio amplifiers, microprocessors, other digital electronics and virtually all products utilizing rechargeable or disposable batteries.

Installation of devices utilizing low voltage DC has been typically limited to locations in which a pair of wires is routed from the voltage source. Increased versatility in placement and powering of low voltage DC products is desirable. Specifically, there is an increasing desire to have electrical functionality, such as power and signal transmission, in the interior building environment, and specifically in the ceiling environment, without the drawbacks of existing systems.

A conventional grid framework, such as one used in a surface covering system, includes main grid elements intersected by cross grid elements therebetween. The main and cross elements form a grid of polygonal openings into which components such as panels, light fixtures, speakers, motion detectors and the like can be inserted and supported. Known systems that provide electrification to devices, such as lighting components, in conventional framework systems utilize a means of routing discrete wires or cables, principally on an "as needed" point-to-point basis via conduits, cable trays and electrical junctions located in the space behind the grid framework.

These known systems suffer from the drawback that the network of wires required occupy the limited space behind the grid framework and are difficult to service or reconfigure. Moreover, the techniques currently used are limited in that the electricity that is provided is not reasonably accessible from all directions relative to the framework plane. For example, electricity can be easily accessed from a ceiling plenum, but not from areas within or below the plane of the grid framework of a suspended ceiling system. Further, the electrical power levels that are typically available are not safe to work with for those not trained, licensed and/or certified.

In known systems utilizing track systems, the connecting devices have terminals that provide electrical connections to conductors provided in a track. These tracks also typically require wiring and mechanical support from the are behind the grid framework. In addition, existing track systems are typically viewable from the room space and are aesthetically undesirable. Further still, known track systems typically utilize higher voltage AC power and connect to AC powered devices, requiring specialized installation and maintenance.

What is needed is a grid framework system that provides low voltage DC power connections that can be safely utilized from all angles relative the plane of the grid framework. The present invention accomplishes this need and provides additional advantages.

SUMMARY OF THE INVENTION

The present invention includes an electrified framework system having a grid element which includes a top portion having a pair of conductors for distributing low voltage electricity disposed thereon. The conductors have opposing polarity and are disposed on opposing surfaces of the top portion of the grid element. The system also includes a connector which is mounted on the top portion of the grid element. The connector includes a means for providing a low voltage power connection between the pair of conductors and another conductive element capable of distributing low voltage electricity.

In accordance with one example embodiment of the invention, an improved connector is provided for installation in the lower box of an electrified grid element. The lower box has a slot and a pair of low voltage conductors. The connector includes a housing which has a wide base portion for lying against the lower box and a narrower top portion for entering the lower box slot. The top portion has a pair of contact elements movably mounted thereon in that the contact elements have end portions for engaging the low voltage conductors housed in the lower box. The connector has a rotator which includes a pair of wings extending therefrom. The winged rotator is rotatable between first and second positions and is coupled to the base portion of the housing. The winged rotator is rotatable without having to rotate any other portion of the housing. The connector also has a cam member mounted on the winged rotator. The cam member interposes the pair of contact elements in the top portion and provides the means for coupling the winged rotator to the contact elements. As the winged rotator is rotated between the first and second positions, the cam member urges the contact elements against the low voltage conductors in the box.

BRIEF DESCRIPTION OF THE DRAWINGS

FIG. 20 FIG. 3 shows an elevational perspective view of a fourth example connector attached to a grid element.

FIG. 23 shows an exploded view of FIG. 22.

Wherever possible, the same reference numbers will be used throughout the drawings to refer to the same or like parts.

DETAILED DESCRIPTION OF THE INVENTION

Figure 1:
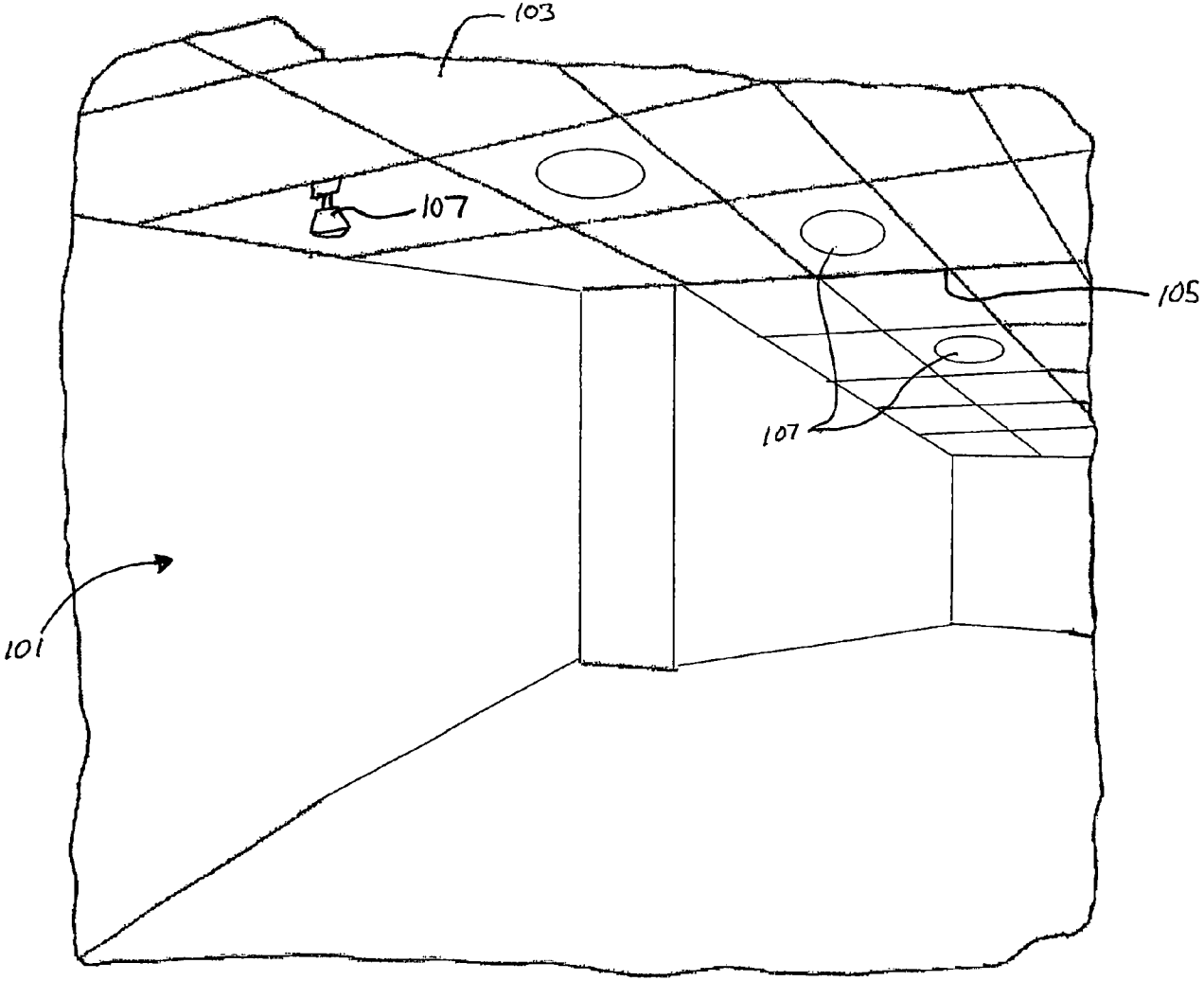
FIG. 1 shows a perspective view of a room space having an electrified ceiling according to an embodiment of the present invention.

The present invention includes connectors for use with an electrified framework. For illustrative purposes, FIG. 1 shows a room space 101 having a ceiling 103 supported by a ceiling grid framework 105. However, any system having a grid framework, including floors and wall, can utilize the technology of the invention. The ceiling 103 may include decorative tiles, acoustical tiles, insulative tiles, lights, heating ventilation and air conditioning (HVAC) vents, other ceiling elements or covers and combinations thereof. Power for the low voltage devices 107 is provided by the conductive material placed upon the ceiling grid framework 105. Low voltage devices 107, such as light emitting diode (LED) lights, speakers, smoke or carbon monoxide detectors, wireless access points, still or video cameras, or other low voltage devices, may be utilized with the electrified ceiling.

Figure 2:
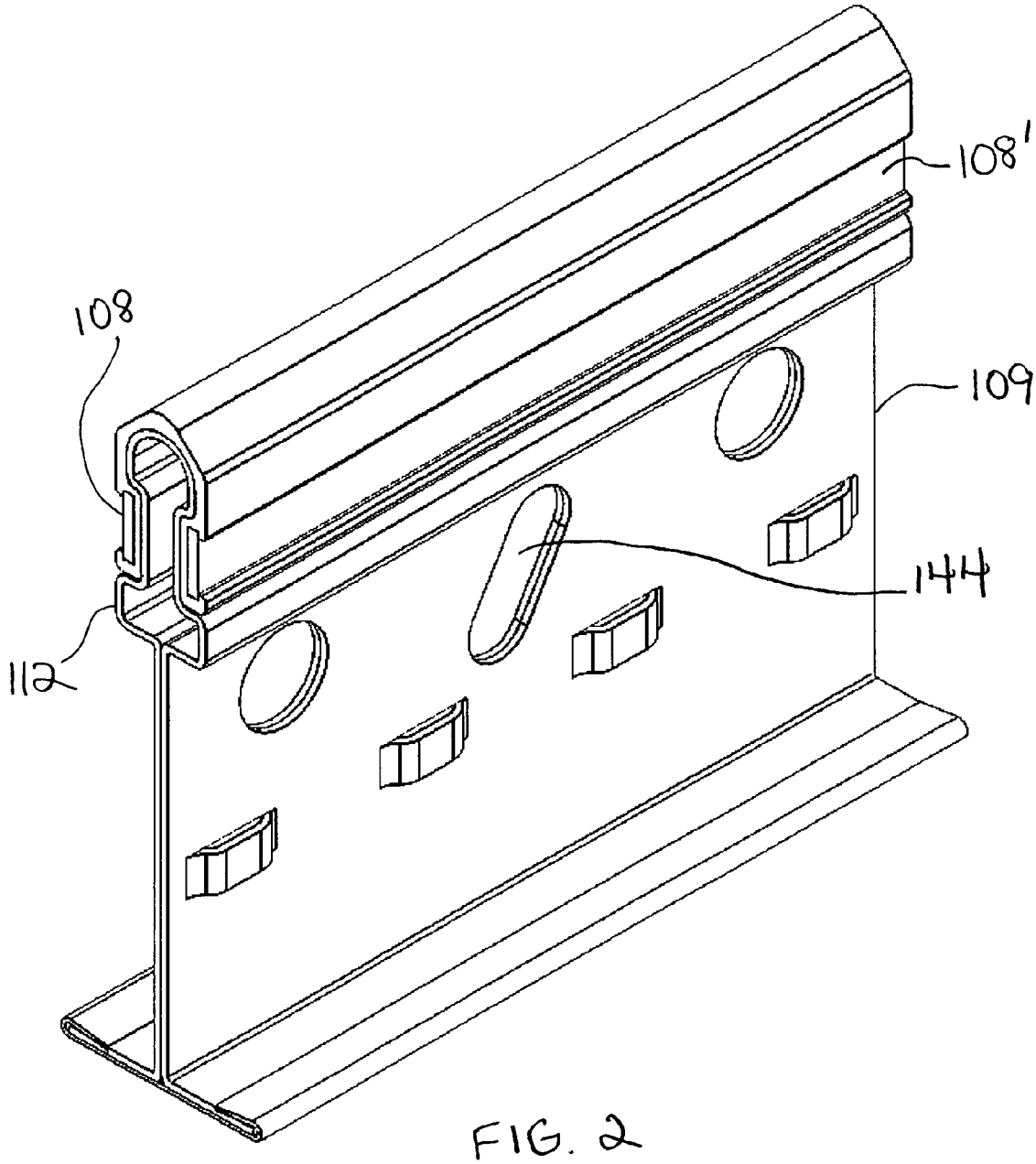
FIG. 2 shows a perspective view of a section of a grid member according to an example embodiment of the invention.
Figure 3:
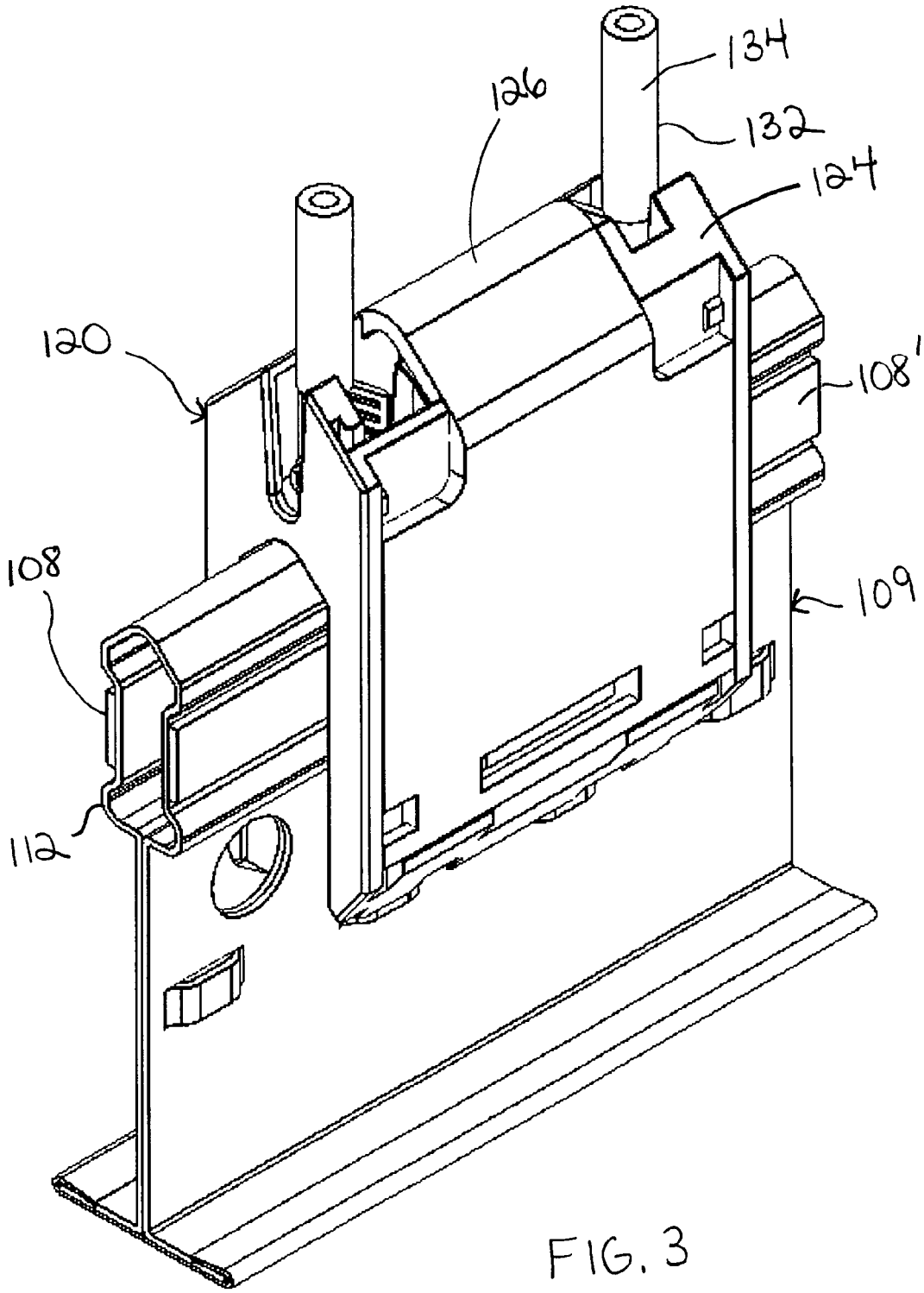
FIG. 3 shows an elevational perspective view of a first example connector attached to a grid element.

Conductive material is disposed on a surface of at least one of the plurality of grid members. In the example embodiment shown in FIG. 2, first and second conductive strips 108 and 108' are disposed on a grid element 109 of the grid framework, and specifically, the top portion 112, e.g. bulb portion thereof. The conductive strips 108 and 108' have opposite polarity, i.e. one is positive and one is negative.

One or more connectors is needed to provide low voltage power connections. For example, a connector is needed to bring power from a power supply to the conductive material disposed on the grid framework. Additionally, a connector is needed to provide an electrical connection between the conductive material on the grid framework and a device such as a light. The various connectors of the electrified framework system are described in greater detail below.

Power-In/Power-Out Connector

Figure 4:
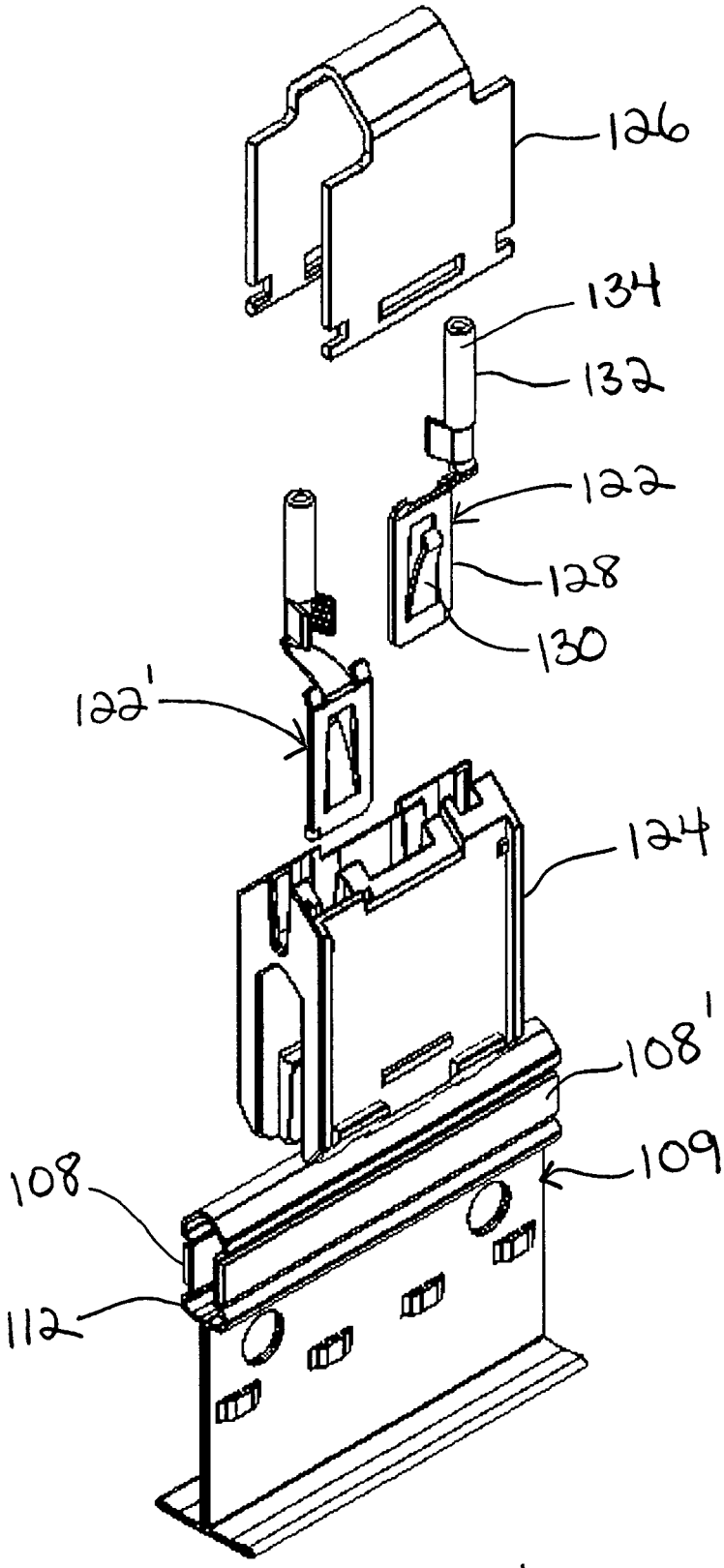
FIG. 4 shows an exploded view of FIG. 3.
Figure 5:
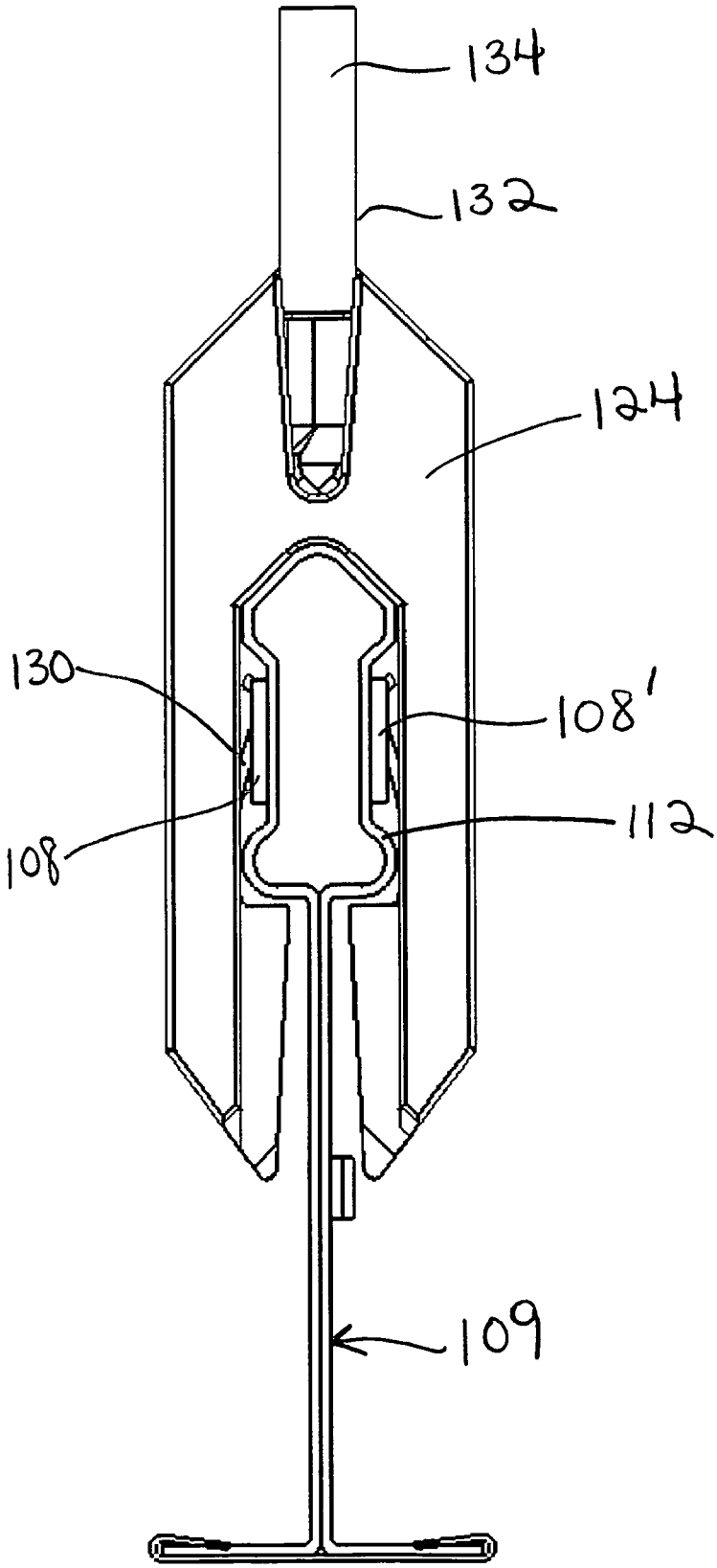
FIG. 5 shows an elevational front view of FIG. 3.
Figure 6:
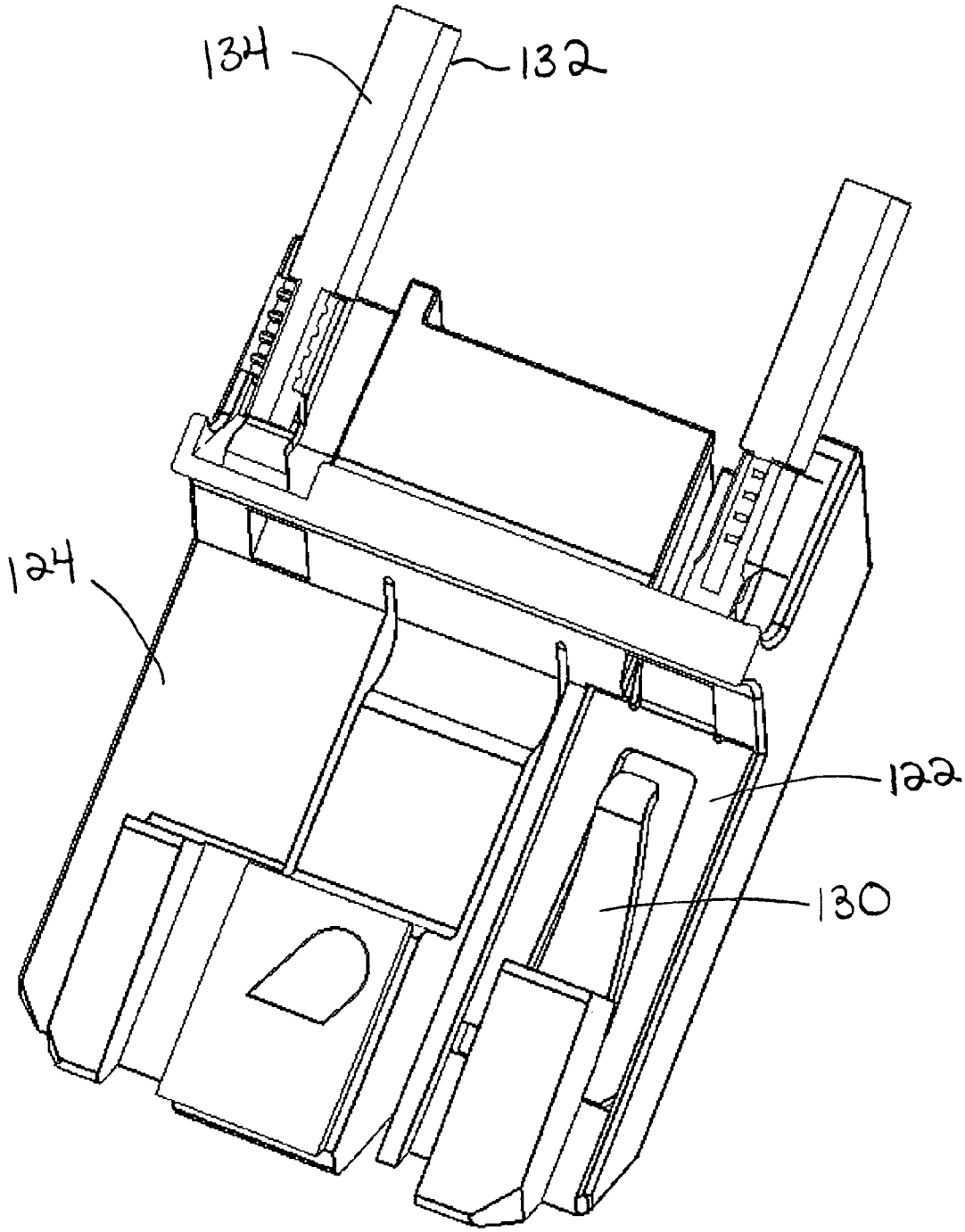
FIG. 6 shows the connector of FIG. 3 shown in partial cross section.

The connector 120 shown in FIGS. 3-6 provides a means for bringing power, or electricity, from a power supply to the conductive material 108 and 108' disposed on the grid 109 or, in the alternative, from the already electrified conductive material to various low voltage devices 107. As best seen in FIG. 4, the connector includes two conductive wire crimp contacts 122 and 122', a nonconductive insulative housing 124 and an outer clamp 126. Each conductive wire crimp contact includes first and second contacting portions. The first contacting portion 128 of the wire crimp contact includes a contact spring 130 which is compliant and upon installation is brought in contact with, i.e. taps, the conductive material disposed on the grid.

The second contacting portion 132 of the crimp contact is also in contact with conductive material. The second contacting portion 132 of the crimp connector, e.g. 122, includes a receptacle 134 which is attachable to the wiring of a low voltage power source when the connector 120 is to be used to power the conductive material disposed on the grid. The second portion is also attachable to the wiring of a low voltage device, where the conductive path is already being electrified by another source and power is needed to be transported away from the conductive material to a device.

The connector shown in the example embodiment of FIGS. 3-6 also includes a flexible U-shaped non-conductive insulative housing 124 which can be mounted to the grid element 109 over the top portion 112. The non-conductive housing 124 accepts, i.e. houses, the wire contacts 122 and 122' and aligns the contacts into the proper position so as to mate each with conductor 108 and 108' disposed on the surface of a grid member 109. In the example embodiment shown, when the connector is mounted onto the grid, each of the first contacting portions of the wire contacts is aligned with a flat conductive wire positioned of the surface of the bulb. As the wire crimp contacts are mounted to the interior wall of the legs of the insulative housing, the insulative housing essentially provides isolation of the contacts from one another, which, in turn, prevents the contacts from shorting with each other.

An outer clamp 126 can also be used. The clamp 126 which is made of rigid, yet somewhat compliant material, snaps over the insulative housing. Although the clamp can be installed, or even pre-assembled, on the housing prior to attaching the connector to the grid element, the clamp can be installed in at least two other ways to minimize insertion forces. First, the clamp can be installed after fully seating the housing on the grid element to provide for low insertion forces. Alternatively, the clamp can be partially installed on the housing in an up position and then fully seated after the housing is in the fully mated position which also provides low insertion forces but require the clamp to be pre-assembled on the housing.

This firm, yet compliant clamp provides several additional advantages. One advantage is that the clamp 126 provides strength to this otherwise flexible "U" shaped housing 124 to assure a tight and electrically sound connection to the conductor paths on the grid framework. The clamp 126 also assists in assuring that the connection is sufficiently strong to prevent it from being dislodged from the grid upon entry and/or removal of devices such as ceiling tiles or other panel devices. In addition, an optional sloping surface of the top portion of the clamp provides ease of entry for devices such as ceiling tiles when the connector interferes with the insertion of the device into the openings formed by the grid framework. Similarly, the bottom, or perch, end of the housing has a sloping surface to assist in removal of devices without causing accidental dislodging of the connector.

Figure 8:
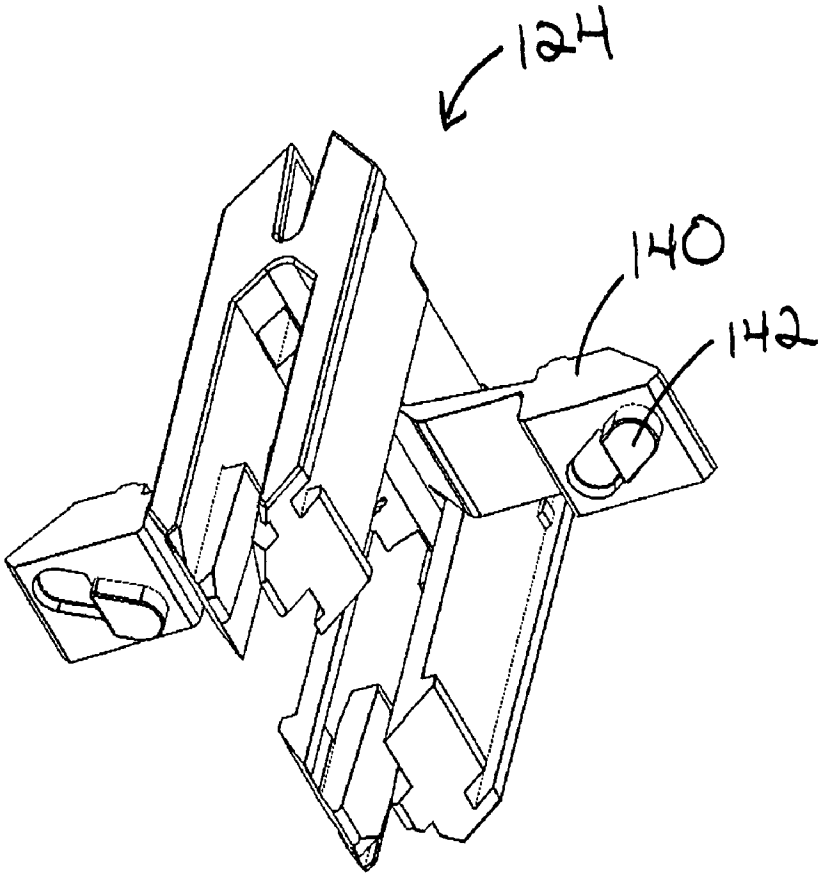
FIG. 8 shows a bottom perspective view of the connector of FIG. 3 with an additional polarization feature.
Figure 7:
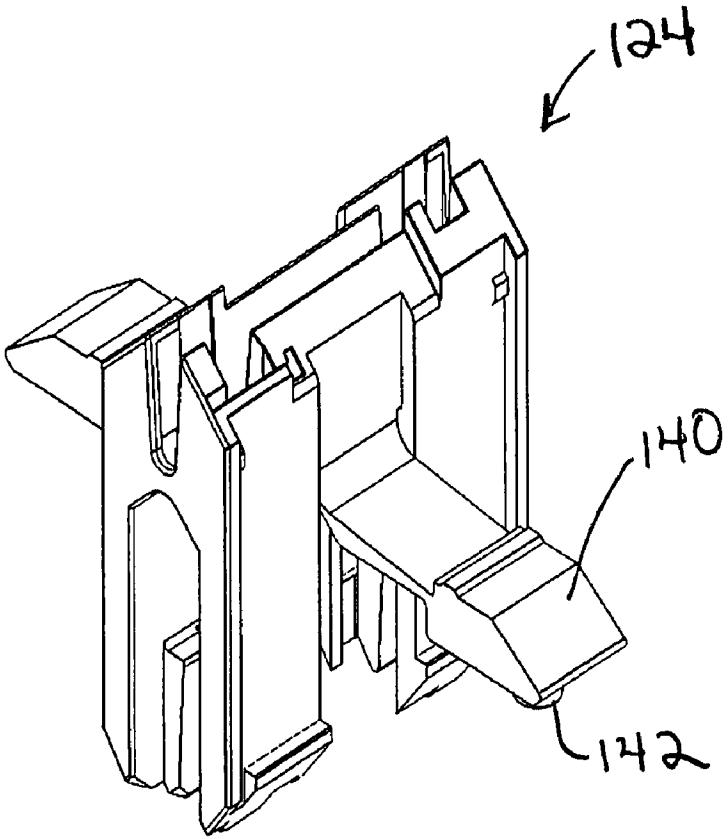
FIG. 7 shows a top perspective view of the connector of FIG. 3 with an additional polarization feature.
Figure 9:
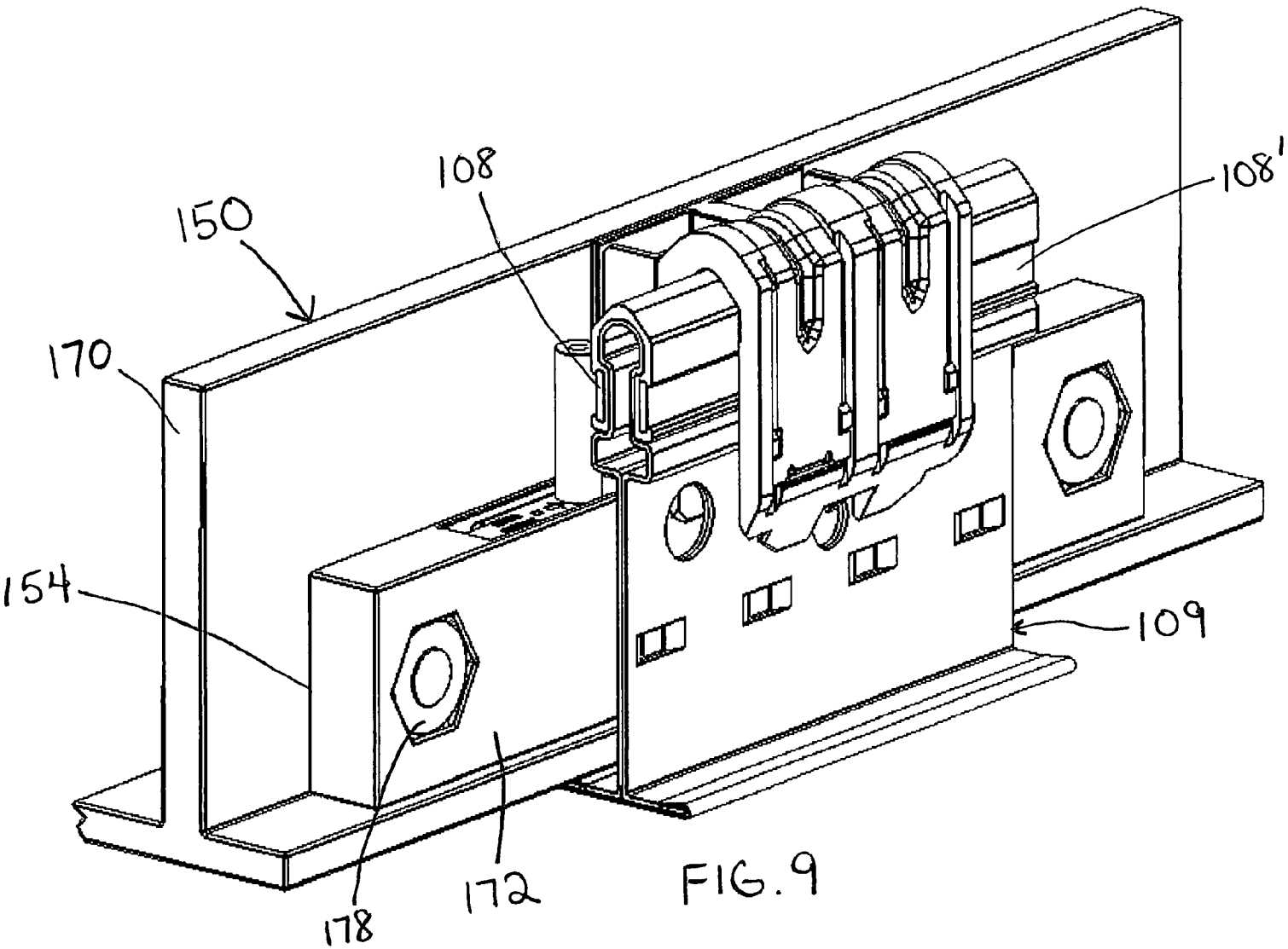
FIG. 9 shows an elevational perspective view of a second example connector attached to a grid element.

An optional feature of the connector 120 is a location/polarization feature. This feature is designed to assure that the connector 120 can only be installed and fully engaged at pre-determined locations on the grid framework. More specifically, the polarization feature, an example of which is shown in FIGS. 7 and 8, is a molded wing 140 contained on each leg of the U-shaped non-conductive connector housing 124. The wings 140 can be rotated either by hand or by the action of fully seating the outer clamp 126 thereon. A protrusion 142 on each molded wing engages and passes through a keying slot 144 (FIG. 2), which is angled, or sloping, which is precisely positioned in the vertical web of the grid member at a pre-determined location. Only when this protrusion 142 of the wing is in proper alignment and seated in the sloping grid slot, will the clamp be capable of being fully seated on the connector housing.

More than one "keying" slot 144 can be positioned on the grid member 109, e.g. at opposing ends, to provide a polarization, or "shorting out", feature. Due to the angle of these sloping slots 144, if a power supply is attached to both, the power will short out. Moreover, the polarization feature can only be attached to the conductive material "one way" to maintain polarity from the power supply. Also, it is worth noting that in order to comply with current Underwriter Laboratory standards, the connector component(s) providing power from the power supply to the conductive material on the grid framework must be separate from other connector components, and specifically, the connector which provides the power-out electrical connection between the conductive material and a device.

Power-Out/Fixture Connector

Figure 10:
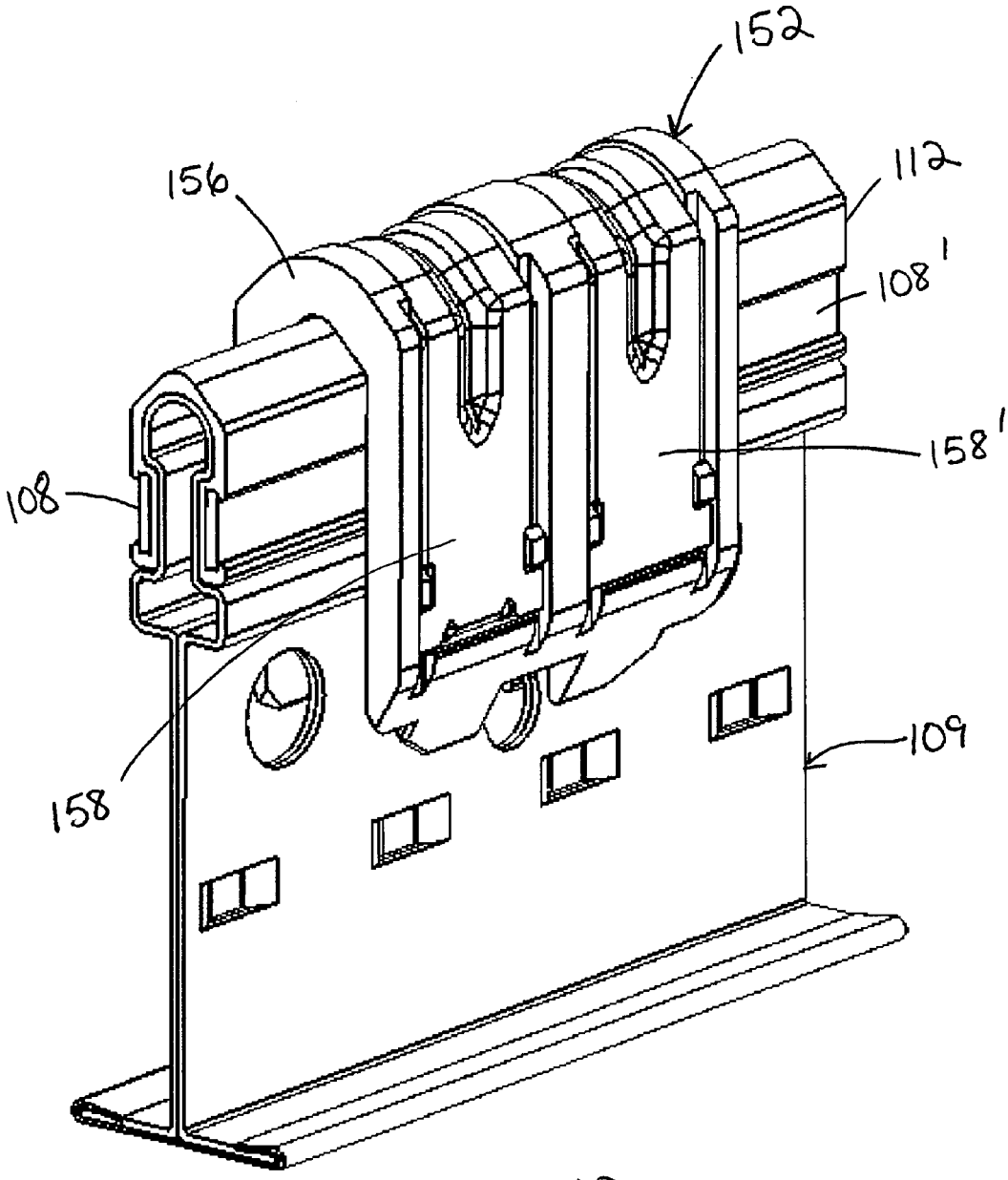
FIG. 10 shows an elevational perspective view of the first member of the second example connector of FIG. 9.
Figure 11:
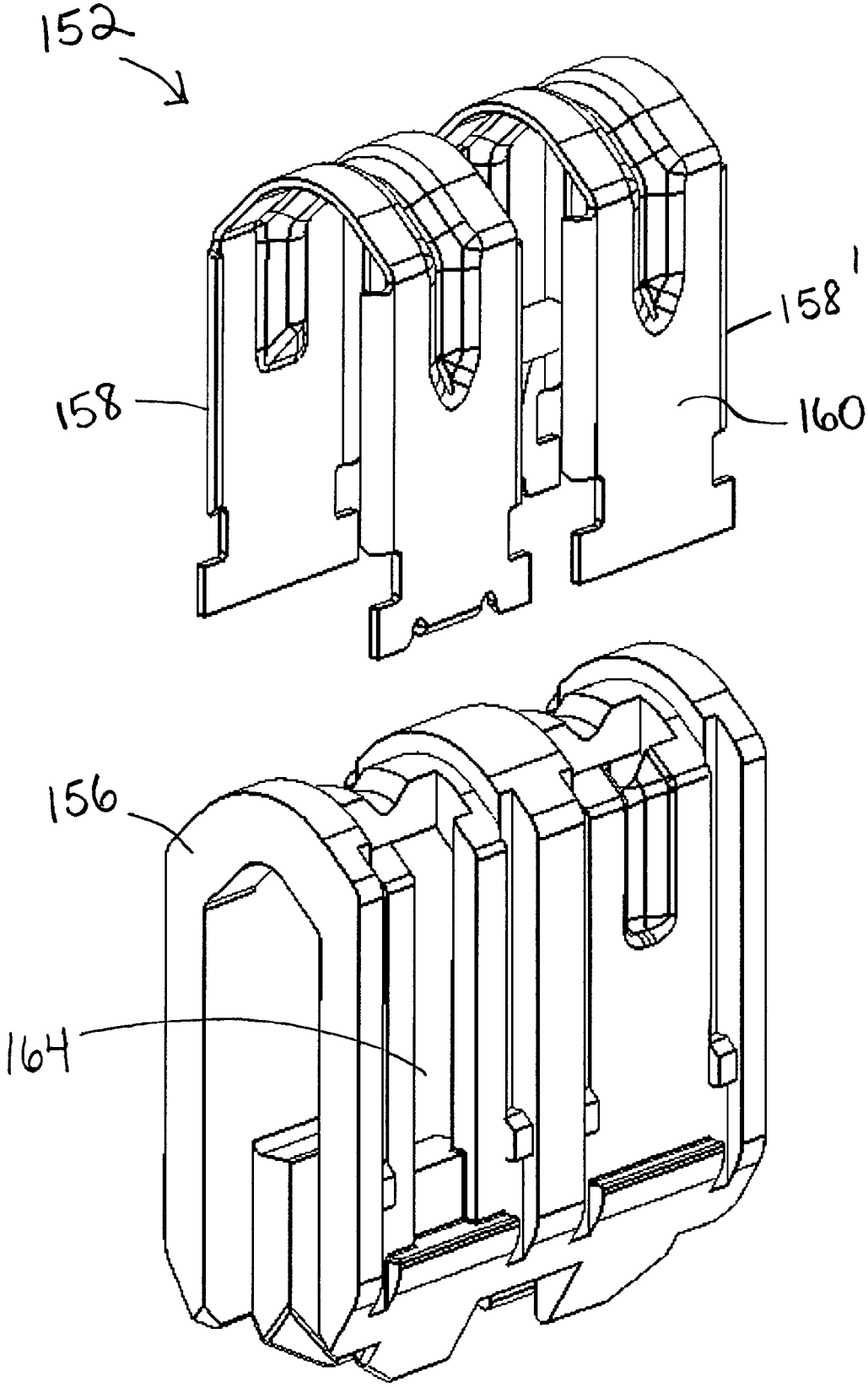
FIG. 11 shows an exploded view of the first member of the second example connector of FIG. 9.
Figure 12:
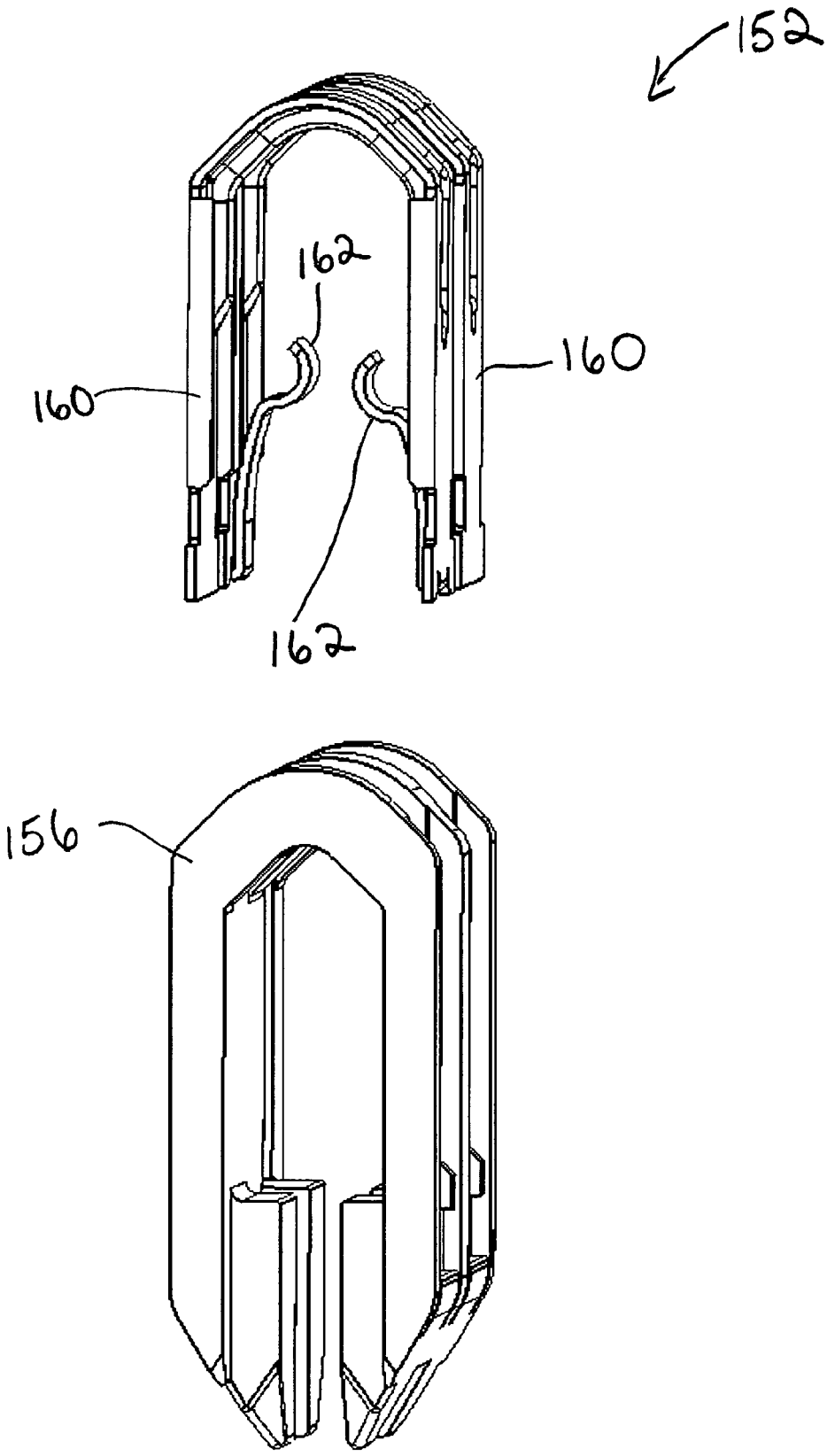
FIG. 12 shows the exploded view of FIG. 11 at a different angle
Figure 13:
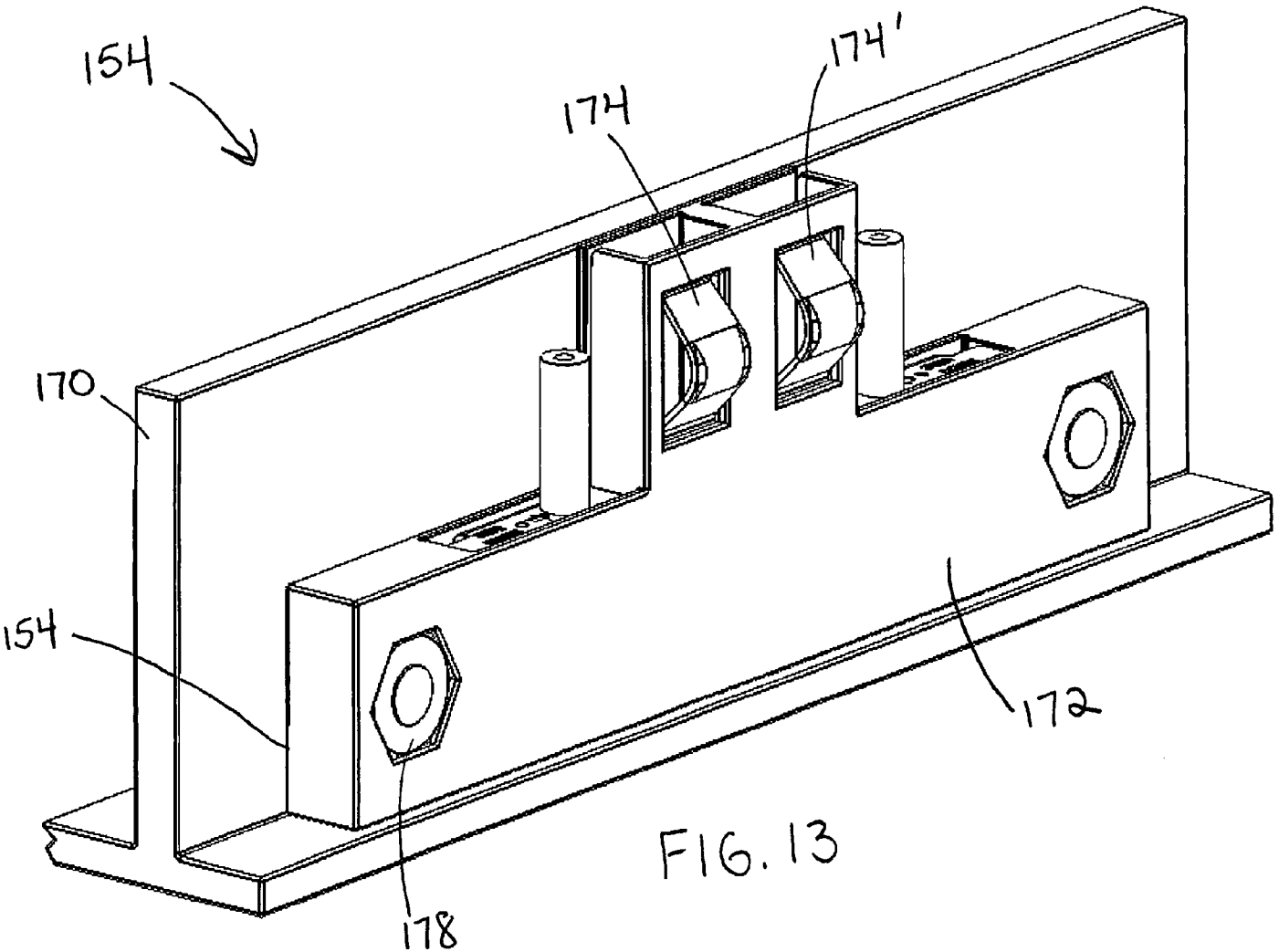
FIG. 13 shows an elevational perspective view of the second member of the second example connector of FIG. 9.
Figure 14:
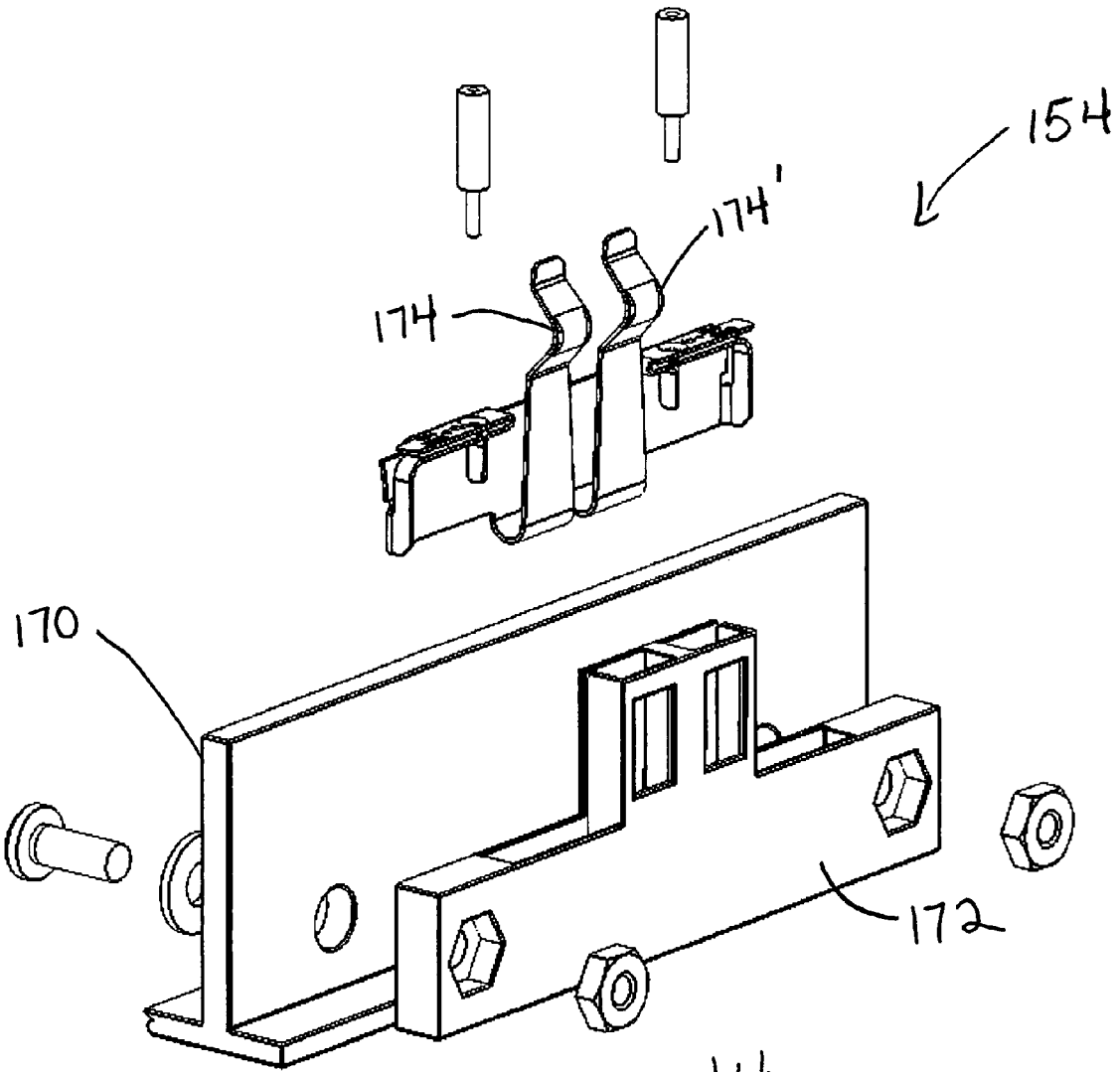
FIG. 14 shows an exploded view of FIG. 13.
Figure 15:
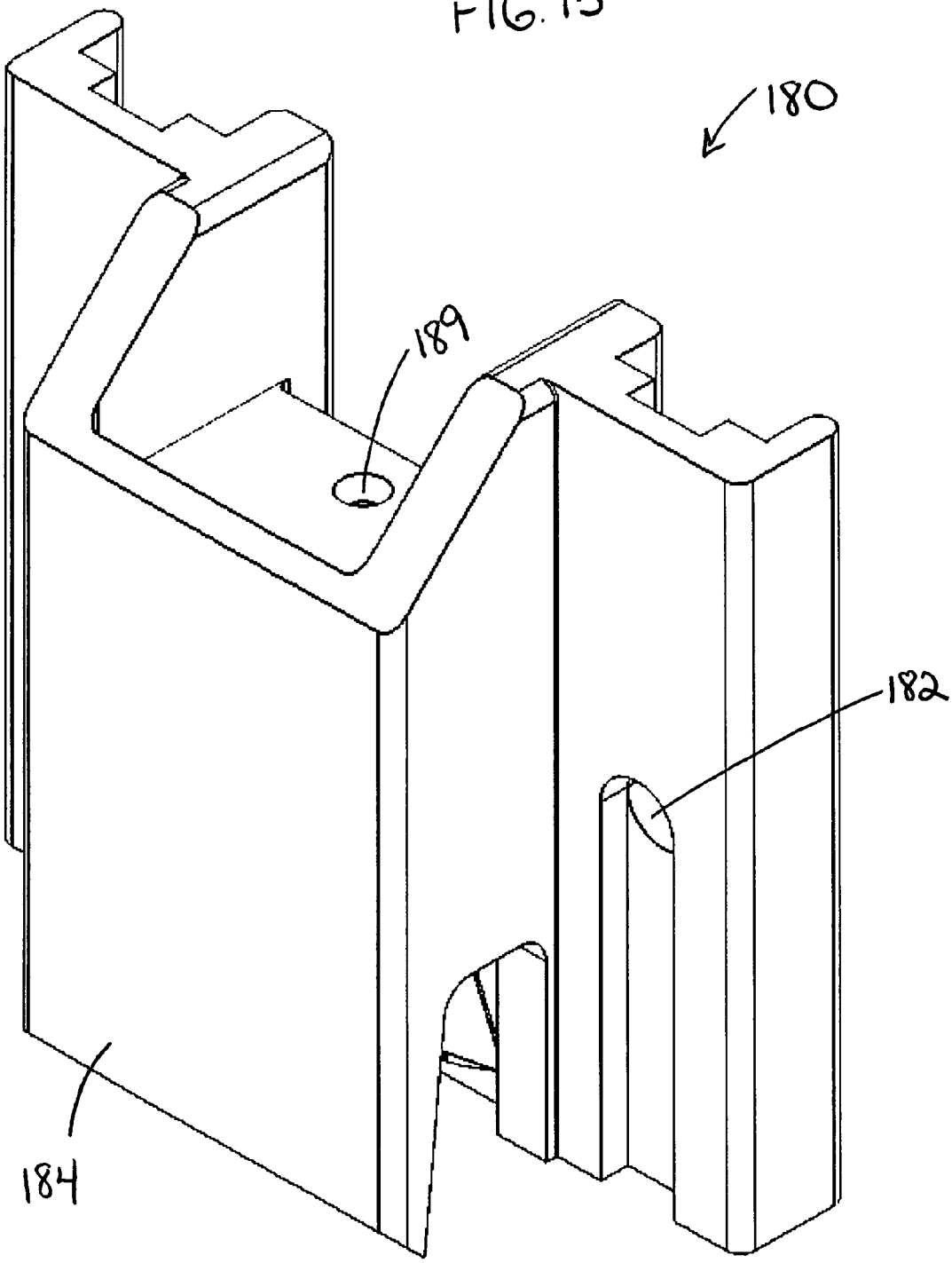
FIG. 15 shows an elevational perspective view of a third example connector.
Figure 16:
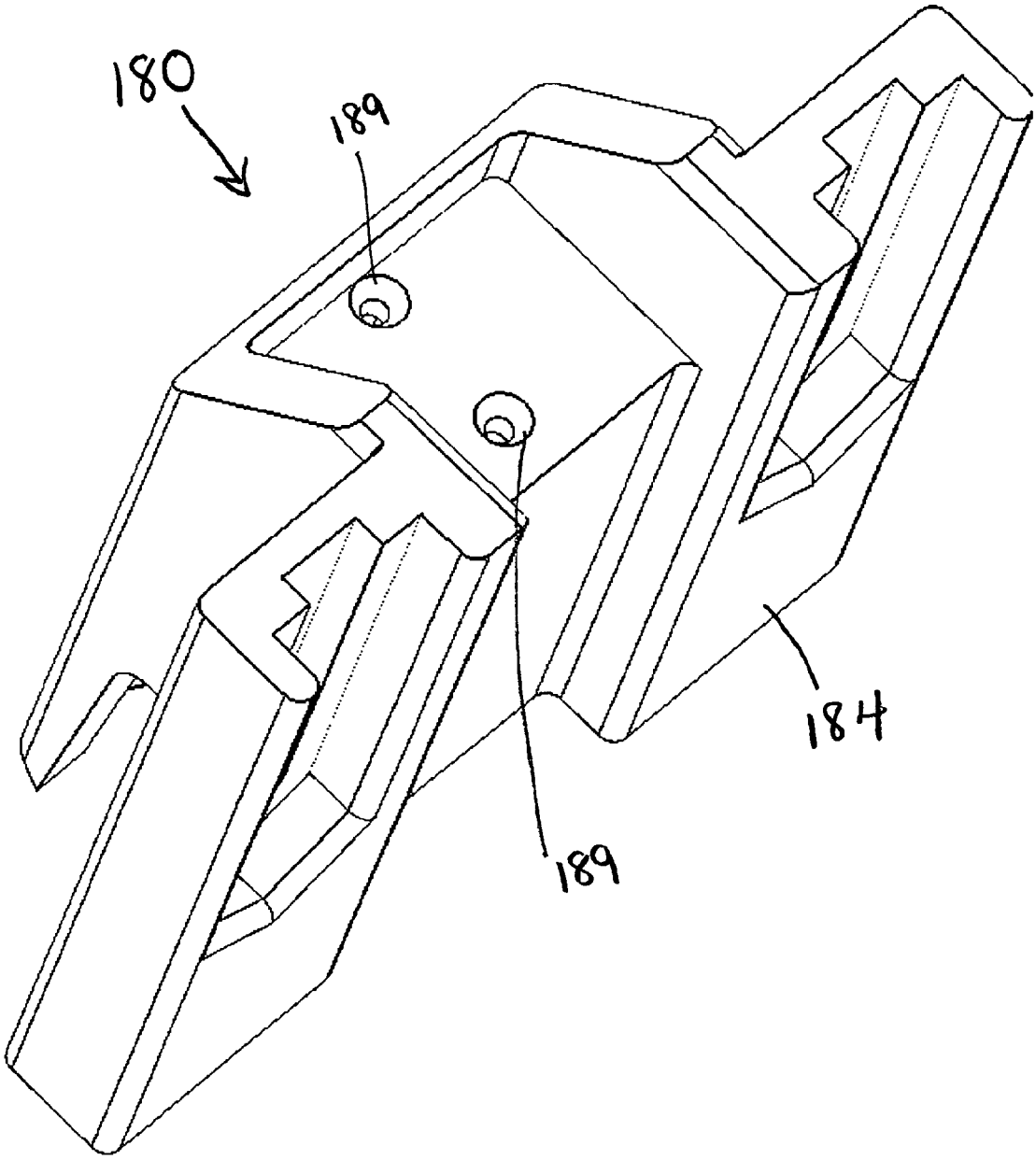
FIG. 16 shows an elevational perspective view of FIG. 15 at a different angle.
Figure 17:
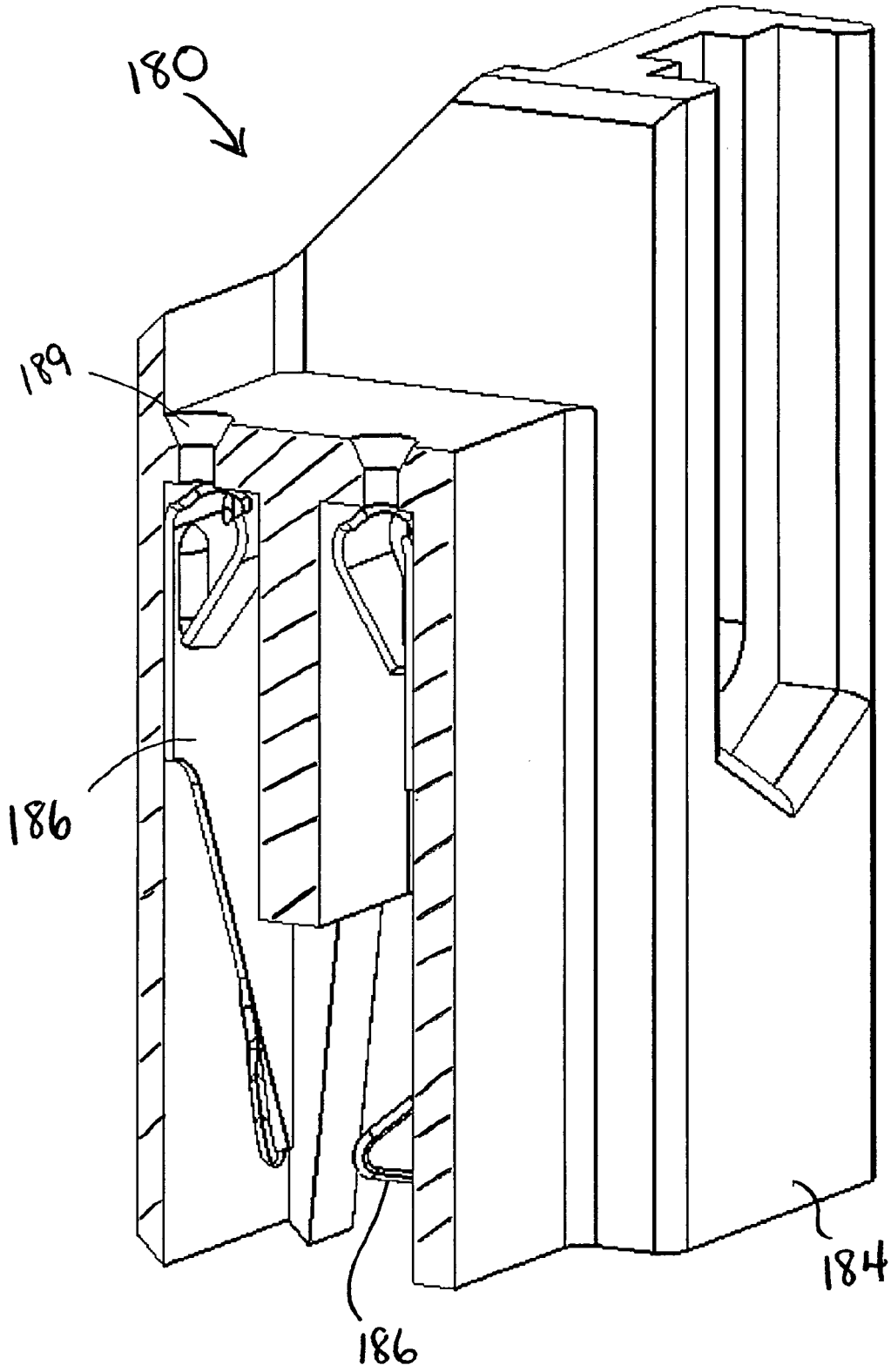
FIG. 17 shows an elevational perspective view of the connector of FIG. 15, in partial cross section.
Figure 18:
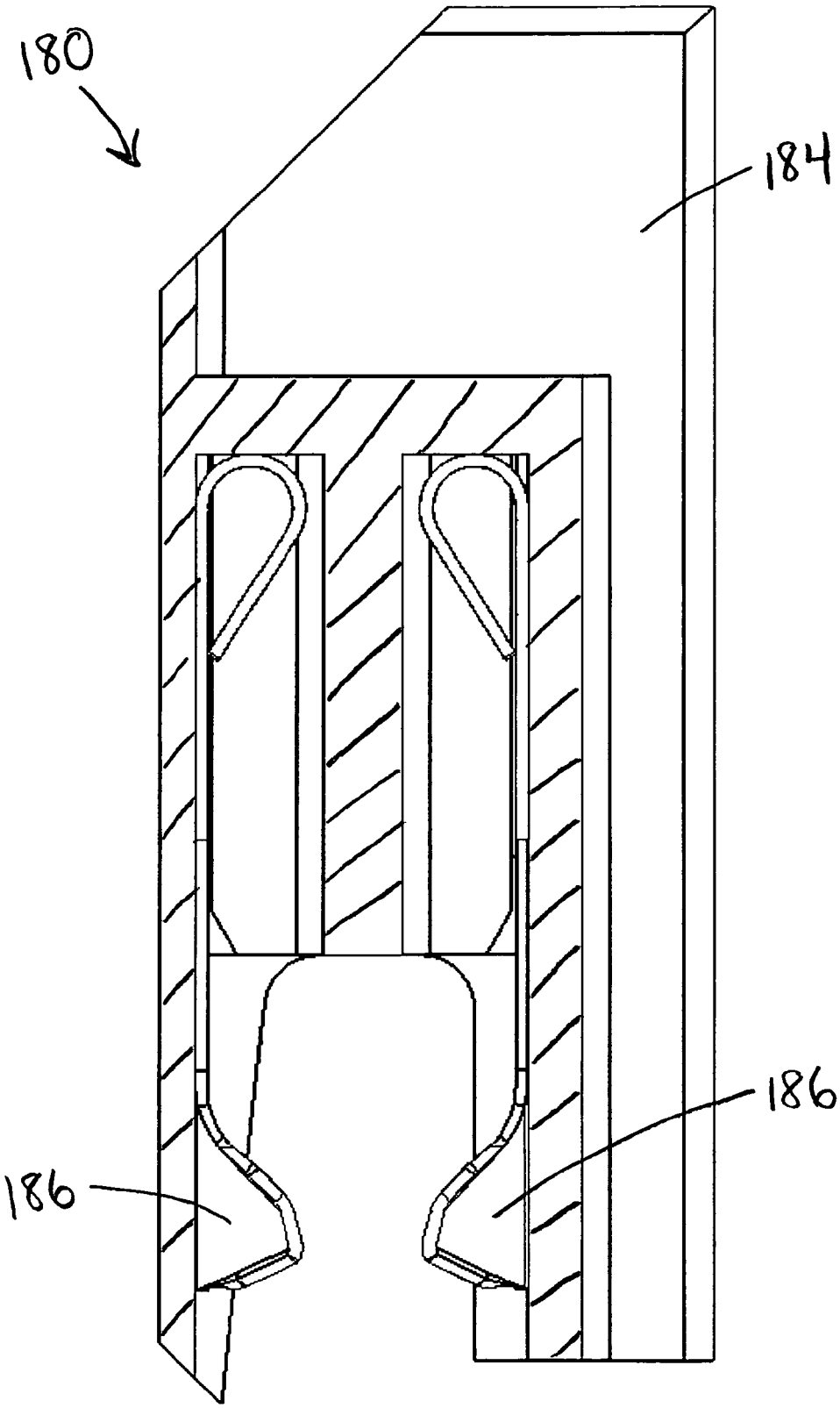
FIG. 18 shows a front elevational view of the connector of FIG. 15, in partial cross section.
Figure 19:
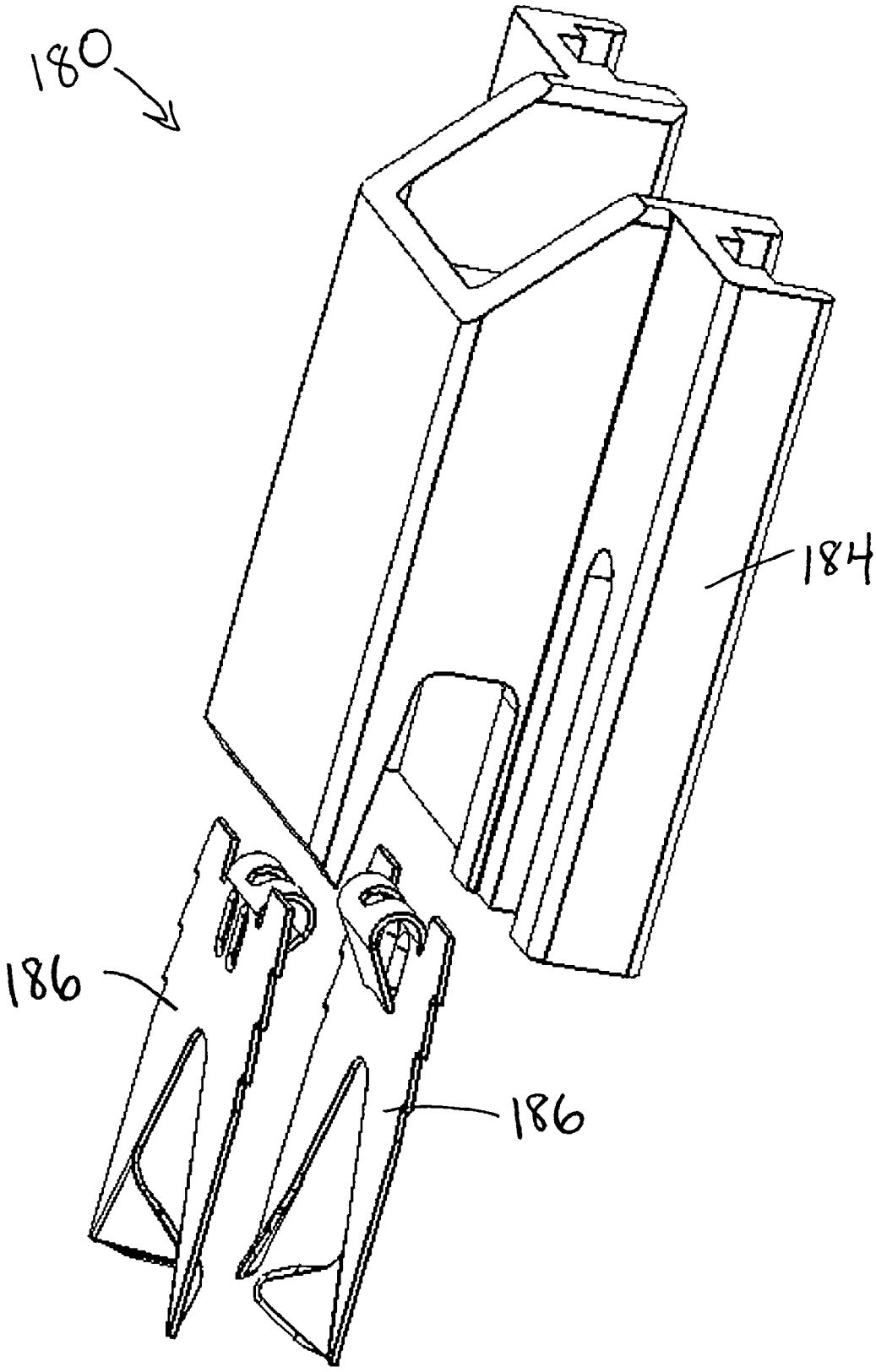
FIG. 19 shows an exploded view of FIG. 15.
Figure 20:
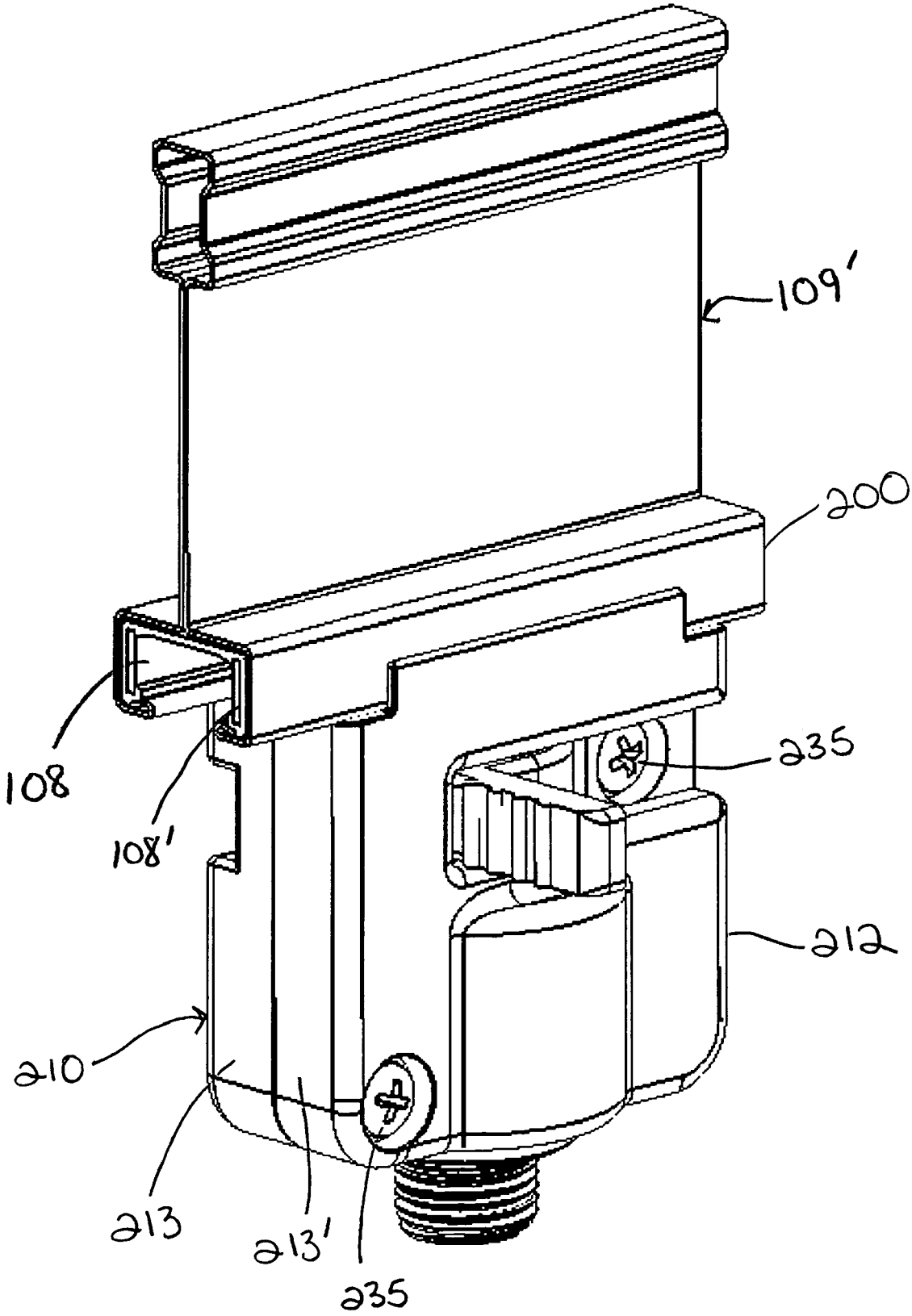
Figure 21:
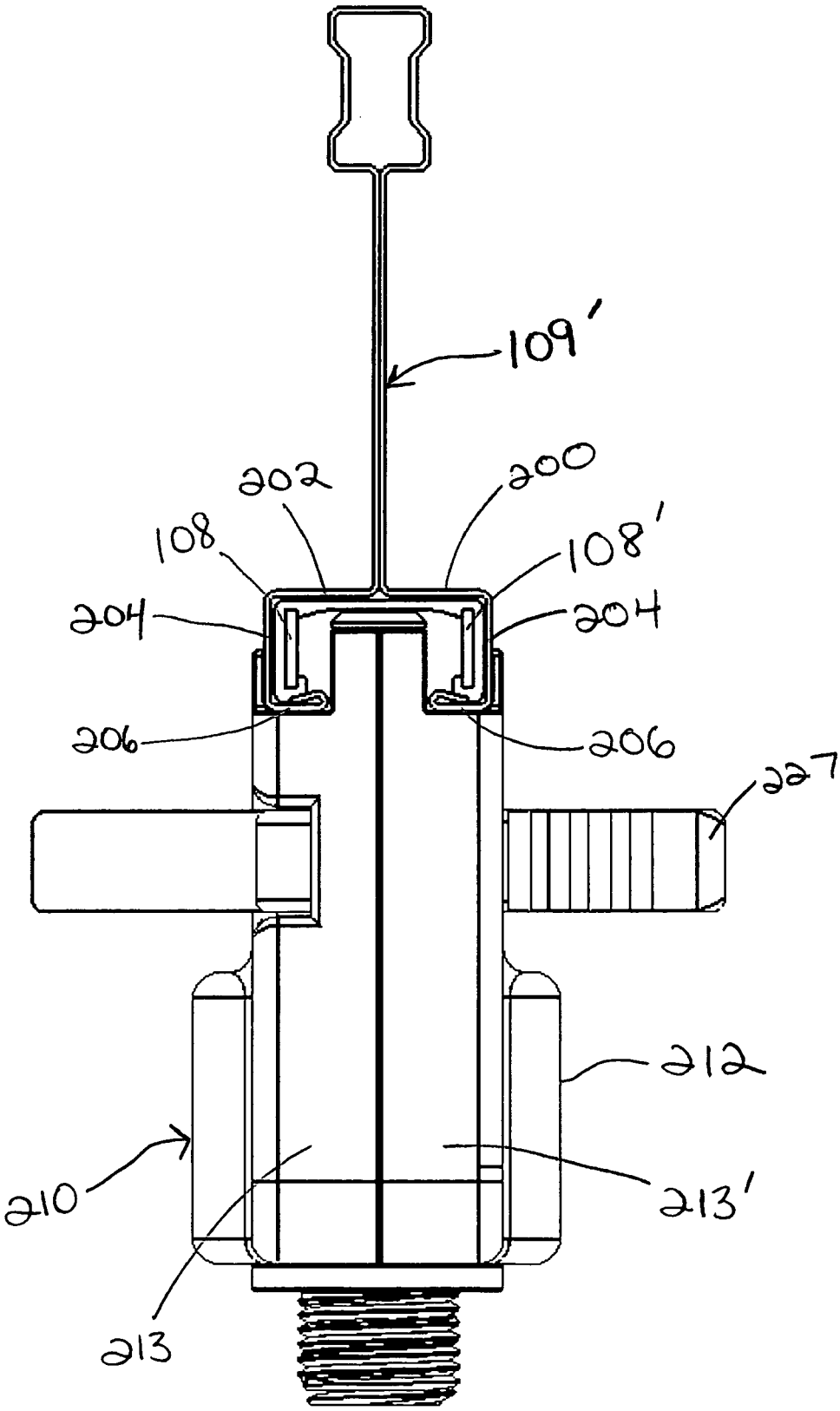
FIG. 21 shows a front elevational view of the connector of FIG. 20.

An example embodiment of a second connector is shown in FIGS. 9-14. This connector 150 provides a separable conductive electrical path between the electrified conductors 108 and 108' mounted on the surface of the grid, e.g. top portion 112, and a fixture such as an electrified tile, lighting fixture (luminary), or similar device mounted in a grid opening formed by the grid framework. The connector 150 includes a first member 152 and a second member 154 which are attached to one another but are separable. As best seen in FIGS. 10-12, the first member 152 includes a non-conductive U-shaped housing portion 156 and a pair of U-shaped conductive contacts 158 and 158', which are preferably comprised of spring metal. The first member 152 is mounted onto the top portion 112 of the grid element 109 and the conductive contacts 158 and 158' are brought into contact with respective conductors, 108 and 108', (the conductors having opposite polarity) disposed on the grid framework. The second member 154 mounts onto the fixture to be inserted in the grid opening.

In the example embodiment shown, the first member 152 of the connector 150 is mounted onto the top portion 112, e.g. bulb portion, of the grid member 109 such that the contacts 158 and 158' touch and make an electrical connection with the two conductors of opposite polarity, 108 and 108', positioned on opposing sides of the top portion of the grid element. Each contact includes a clamp portion 160 and a spring portion 162. The clamp portion is composed of a resilient material which assures that the connection to the bulb is secure and prevents accidental dislodgement.

The outer surface of the clamp 160 also serves as the mating contact area for the fixture contact springs which will be described in more detail below. This mating contact area is relatively large and is designed to accommodate a wide tolerance range of fixture positioning. Also, in the example embodiment shown, the top and bottom surfaces of the first member, and, in turn, at least the clamp 160, have a sloping surface which allows the grid to rotate or cam away from the interference of a ceiling tile, or other device, upon installation or removal. This rotation of the grid also assists in preventing accidental dislodgement of the connector.

The spring 162, which can be thinner and less rigid than the clamp portion, extends from the interior wall of the outer clamp 160. The clamp 160 is positioned over the housing 156 such that each spring 162 mates with and is seated in a slot 164 (FIG. 11) on the housing 156. The slot 164 provides access for the spring 162 to contact a conductor positioned on the bulb of the grid.

The second member 154 of the fixture connector 150 is attached to a device 170 (represented in the drawings as an inverted T element) and includes an insulative housing 172 and two compliant fixture connector contact springs 174 and 174'. The insulative housing 172 accepts and houses the two compliant contact springs, 174 and 174', and holds them in a position. As shown, the springs are in alignment and mate with the outer surface of a respective clamp 160 of the first member 152 of the fixture connector 150 which creates an electrical connection between the complaint springs 174, 174' of the second member 154 and the conductive material 108 and 108' disposed on the surface of the top portion 112 of the grid member 109. The two second member compliant connector springs 174, 174' can accommodate a wide variation in fixture positioning in the grid framework.

Each of the two springs 174, 174' have a poke-home type of receptacle connected thereto to receive the fixture wiring. The conductor is then pushed through the hole in the contact, thereby trapping the conductor between two metal surfaces, one being compliant and the other being rigid. The wire can be removed by pressing a pointed tool through the release hole adjacent to the wire, deflecting the compliant surface to release its grip on the wire thereby allowing removal of the conductor.

As shown in the various drawings, the second member can be attached to the side of a device 170 via a fastening means 178 such a mechanical fastener such as screws which engage with self-contained hex nuts.

In-Plane Single Connector

An alternative to the two-piece fixture connector 150 described above, is a connector 180 comprising a single piece as shown in FIGS. 15-19. As with the two-piece connector described above, the purpose of the single-piece connector 180 is to provide a separable conductive electrical path between an electrified tile, lighting fixture (luminary), or other similar device in a suspended, generally planar and rectilinear-configured grid framework.

The single-piece connector, which is preferably attached to a device, rather than the grid element 109, via a fastening means such as a screw type fastener. The fastener can be inserted through aperture 182. Connector 180 includes an insulator housing 184 and two contacts 186. The insulator housing 184 accepts the compliant contacts 186 and holds them in proper opposing relation in order to align and mate the contacts 186 with the conductive material 108 and 108' positioned on opposing sides of the grid member 109. As shown in the Figures, the housing 184 has a recess formed in the base thereof which generally conforms to the shape of the top portion 112 of a grid element 109 such that the housing 184, and, in turn, the connector 180, can be mounted over and down onto the top portion 112 of the grid member 109.

The connector housing 184 also includes a pair of apertures 189 for inserting the wiring from the device to which the conductor 150 is attached. The apertures 189 provide access to the contact springs 186 so that the wiring from a device, such as device 170, can be brought into contact with the body of the spring 186 in order for an electrical connection to be made between the conductive material 108 and 108' on the grid and the device to be powered via the spring.

There are several differences, and, in many instances, advantages of the single-piece connector as compared to the two-piece connector described above. One difference is that the fixed contacts inside of connector provide controlled normal forces. As a result, the electrical interface is not dependent on grid opening dimensions. The result is improved fixture to grid tolerance control. Also, no independent installation of the connector to a grid member is required which improves cost of the connector as well as a reduction in labor time. Further, the single-piece can electrically connect the device anywhere along the grid, thereby eliminating potential interference with existing fixture features. Also, the one-piece connector provides greater flexibility in replacing devices, and, thus, it is "device supplier friendly". Since the connector is attached to the fixture, no connector remains on the grid when the fixture is removed. Also, the one-piece has minimum electrical interfaces which translates to high reliability. The one-piece eliminates the potential to miss-locate or inadvertently disturb the grid mounted portion of the connector. Also, debris will not lodge in the electrical interface.

Underside Connector

In known track systems, the connecting devices have terminals that provide electrical connections to conductors provided in a track. These tracks have the drawbacks that they typically require wiring and mechanical support from the plenum space above the ceiling grid framework. In addition, the track systems are typically viewable from the room space and are aesthetically undesirable. Further still, known track systems typically utilize higher voltage AC power and connect to AC powered devices, requiring specialized installation and maintenance.

As shown in FIGS. 20-23, another aspect of the invention is a connector for making a low voltage electrical connection between a device and conductors 108, 108' housed inside the lower box 200 of a grid element 109' is provided. More specifically, the conventional lower box 200 configuration typically has a base wall 202, a pair of side walls 204 and a pair of flanges 206 that define a slot therebetween. As shown, the box 200 includes a pair of electrical conductors 108, 108' which are positioned on the surface of the pair of sidewalls 204.

The purpose of an underside connector is not only the flexibility of attaching the connector to the box of a grid member at any position along the length of the grid box but also to make a robust mechanical connection with the grid member and an electrical connection between the conductive material and various devices. The example connector 210 includes a connector housing 212 comprising two halves 213 and 213'. The connector housing 212 includes a narrow hanger portion 214 and a wider lower body portion 216. The connector 210 is installed by first inserting the hanger portion 214 through the slot of the box. The connector 210 is properly seated in the box 200 by pressing the connector into the box until the top of the lower body portion 216 is in contiguous relation with the pair of flanges 206 of the box which define the slot.

The hanger portion 214 includes two resilient spring contacts 220. The spring contacts 220 are interposed by a cam 222, or gear, housed in a rotator 225. In the example embodiment shown in Figures, the cam 222 is pressed onto the rotator 225. When the connector 210 is properly seated in the grid box 200, the contacts 220 are in parallel alignment with the longitudinally extending conductors 108, 108' positioned on the sidewalls 204 of the box 200.

The connector is configurable in a first position (shown in FIGS. 20-22) and a second position. The first position permits insertion of a portion of the connector into an opening in the lower box of a grid element. The second position engages the electrified ceiling framework to provide an electrical connection as well as mechanical support to the connector and devices that may be attached thereto. The connector is moved from position one to position two by turning the winged rotator from a position generally perpendicular to the plane of the grid element until the wing 227 reaches the second position that is parallel with the plane of the ceiling grid member.

Upon rotation of the winged rotator from position 1 to position 2, the center cam 222 is also turned and the top portion 240 of the cam causes the contact elements to spring apart so that their contacting ends move against the conductors while the expandable hanger locks into the track. In other words, the cam and spring contacts provide a compliant biased contact configured to provide electrical contact to a conductive surface of the electrified ceiling framework. The connector can be disconnected from the grid member by rotating the rotator wings in the opposite direction which, in turn, allows the cam/gear to disengage and the expandable hanger and spring contacts to retract into their original unexpanded position.

Figure 22:
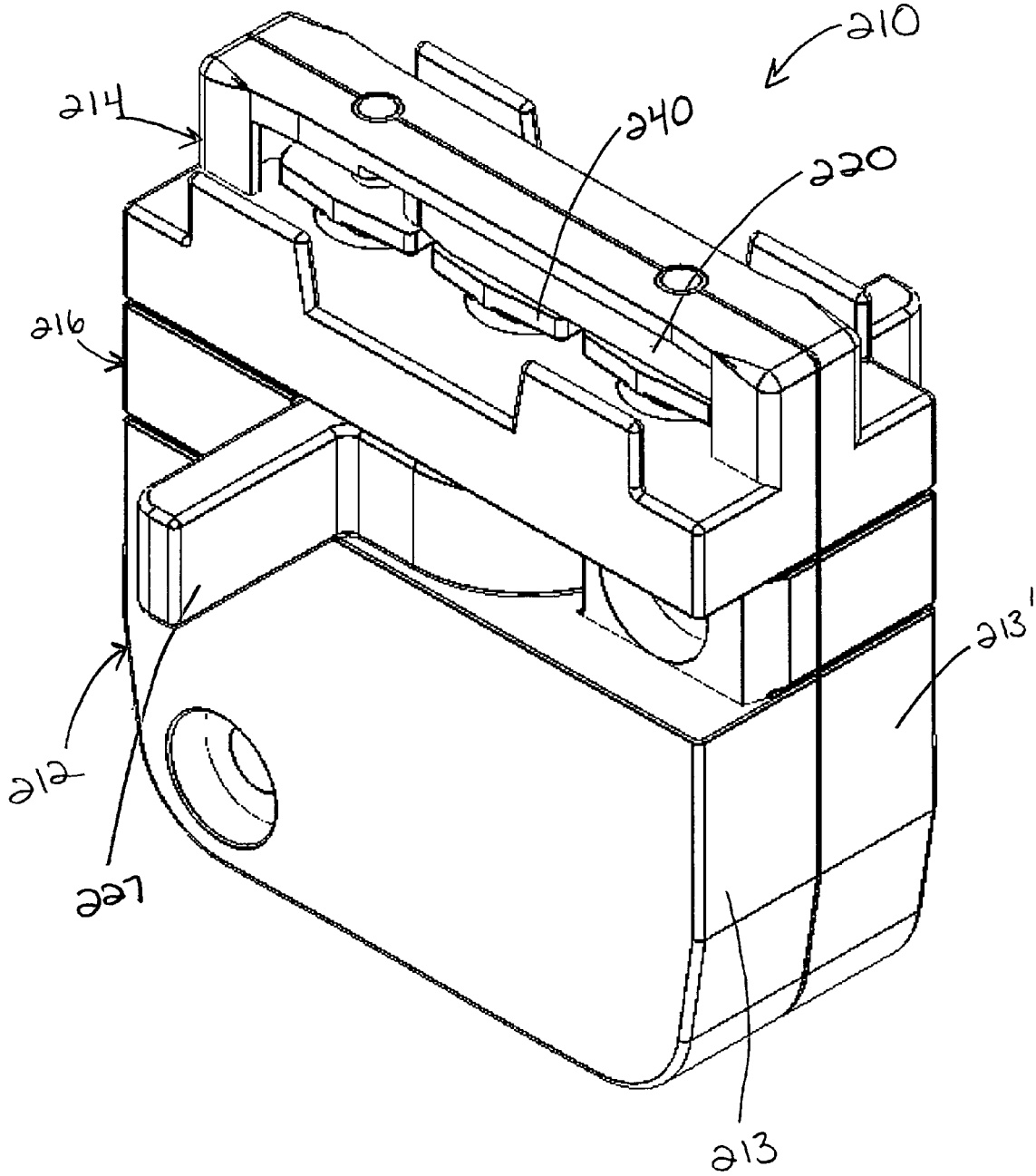
FIG. 22 shows an elevational perspective view of the connector of FIG. 20.

FIGS. 22 and 23 illustrate a "triple cam" which, in addition to the cam on the centerline of the connector, includes two additional outboard cams 223 and 223'. The outboard cams are held in place by a cam carrier 245 which is attached to the center cam and which aligns the cams in a linear row. The cam carrier mates with receiving features 230. The addition of the outboard cams/gears substantially increases the mechanical retention of the connector to the grid and eliminates sensitivity to positioning in grid framework.

The connector is operated by placing the expandable hanger into the grid box and turning the rotator wings which, through the gear drive mechanism will cause the lobes of the all three rotatable cams/gears to overlap the lower surface of the grid box as well as the expandable hanger and spring contacts to expand outwardly in the grid box, thereby making the aforementioned electrical and mechanical connections. The connector can be disconnected from the grid member by rotating the rotator wings in the opposite direction which, in turn, allows all three cams/gears to disengage and the expandable hanger and spring contacts to retract into their original unexpanded position. It should be noted that the cams/gears are synchronized in their movement, i.e. the cams/gears are geared on timing.

The connector is designed to hold a fixture and carry low voltage current thereto. A conventional threaded stud can be attached at the bottom of the connector housing to hold a fixture such as a camera or lighting device. The underside connector also includes miscellaneous conventional fixture mounting hardware such as strain reliefs, nipples, etc. for attaching a fixture, such as a pendant light, to the connector. The jacket of the two wires is strain relieved using a strain relief that interferes with the fixture mounting hardware. The ends of the wires are then attached to the connector spring contacts by placing them under and tightening the two binding head screws 260. The fixture wires are then threaded through the fixture mounting hardware.

The example connector shown in the drawings is assembled by: positioning the rotator on apertures extending through the lower body of the housing; positioning the preassembled cam/gear and cam/gear carrier into receiving features 230 in one housing half, dressing the lead wires; sandwiching all of the components in two housing halves; and securing the housing halves to one another via a mechanical locking mechanism, such as self tapping screws 235.

There are several advantages to the two underside connectors described above including, but not limited to: a stationary body in which the wires extending therethrough do not twist (thus a 360 degree opportunity is provided); additional spring not needed to lock connector grid box; long compliant spring contacts; mechanical amplification of contact movement to negate large grid box tolerances; spring contacts are concealed and therefore protected from abuse and damage; contacts provide small wipe with conductors in grid box to provide electrical interface, rotator has no longitudinal load; simple actuator means; large actuator levers for mechanical advantage and robustness; actuator is visibly apparent in open and closed positions for intuitive operation; rails at the top of housing prevent grid box from spreading; the connector cams into the grid box if not fully inserted when actuated; connector housing can be styled in many shapes (round, square, etc); the connector housing spring contacts and outboard cams/gears are twin components; and the outboard cams/gears are not necessary if connector is used at locations other than the grid intersections which, in turn, reduces the cost of the connector.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. A connector for installation in a longitudinally extending lower box of an electrified grid element, the lower box having a pair of low voltage conductors disposed therein, wherein the connector includes a housing and a pair of contact elements movably mounted thereon, the contact elements having end portions for engaging the low voltage conductors, the improvement comprising:

a rotator having a pair of wings extending therefrom, the winged rotator being coupled to the housing and being rotatable between first and second positions, the winged rotator being rotatable without having to rotate any other portion of the housing;

a cam member mounted on the winged rotator, the cam member interposing the pair of contact elements, wherein the cam member provides the means for coupling the winged rotator to the contact elements; and wherein upon rotation of the winged rotator the cam member is rotated and the cam member urges the contact elements against the conductors in the box thereby providing and electrical and mechanical connection between the connector and the lower box of an electrified grid element.

2. The connector of claim 1, wherein the connector includes a threaded stud, the threaded stud extending outwardly from a bottom surface of the connector housing and providing a means to mount a device thereto.

3. The connector of claim 1, wherein the lower box includes a base wall extending substantially horizontally, a pair of side walls extending substantially vertically from the edged of the base wall and a pair of return flanges extending substantially horizontally, the return flanges forming a longitudinally extending slot therebetween.

4. The connector of claim 3, wherein the pair of conductors are positioned parallel the sidewalls of the lower box.

5. The connector of claim 4, wherein the contact elements are in parallel alignment with the pair of conductors.

6. The connector of claim 1, wherein the cam member means for coupling the rotator to the contact elements is a top cam portion which positively locks in the lower box of the grid element.

7. The connector of claim 6, wherein at least the top cam portion of the cam member is positioned in the box at a height above the pair of horizontally extending return flanges of the grid box.

8. The connector of claim 1, wherein the cam member is positioned on a vertical centerline of the connector.

9. The connector of claim 8, wherein the connector includes first and second outboard cams.

10. The connector of claim 9, wherein the centerline cam and two outboard cams are synchronized in their movement.

11. The connector of claim 9, wherein the first and second outboard cams are positioned on opposing sides of the cam member positioned on the centerline of the connector.

12. The connector of claim 11, wherein the first and second outboard cams assist in the mechanical retention of the connector in the lower box of the grid element and eliminate sensitivity of positioning of the connector in the grid framework.

13. The connector of claim 11, wherein the first and second outboard cams are held in place by a cam carrier which is attached to the cam member positioned on the centerline of the connector.

14. The connector of claim 13, wherein the cam carrier aligns the first outboard cam, the second outboard cam and the cam member positioned on the centerline in a linear row.

15. An electrified framework system comprising:

a grid element having a top portion extending in a substantially vertical plane, the grid element includes first and second conductors of opposing polarity, the conductors being disposed on the top portion of the grid element and being positioned on opposing sides of the vertical plane in which the top portion extends substantially; and a connector, the connector being mounted over the top portion of the grid element, the connector having a means for providing a low voltage power connection, wherein the connector includes first and second conductive wire crimp contacts and a nonconductive housing.

16. The electrified framework system of claim 15, wherein the means for providing the low voltage power connection is between the conductors and a power supply, the connector bringing power from the power supply to the conductors, whereby the conductors are electrified.

17. The electrified framework system of claim 15, wherein the connector includes a polarization means.

18. The electrified framework system of claim 15, wherein the nonconductive housing insulates the first wire crimp contact from the second wire crimp contact whereby the first and second wire crimp contacts are prevented from shorting out one another.

19. The electrified framework system of claim 15, further comprising a clamp, the clamp being positioned over the housing, the clamp providing strength to the housing and assuring an electrical connection is maintained between the wire crimp contacts and the conductors.

20. The electrified framework system of claim 15, wherein the first and second conductors are electrified and the low voltage power connection is between the conductors and a low voltage device, the connector transporting power away from the first and second conductors to the low voltage device, whereby the low voltage device is powered.

21. The electrified framework system of claim 20, wherein the low voltage device is selected from the group consisting of a lighting fixture and an electrifiable tile.

22. The electrified framework system of claim 15, wherein the first wire crimp contact includes first and second contacting portions.

23. The electrified framework system of claim 22, wherein the first contacting portion includes a contact spring which is compliant and in contact with at least one of the first and second conductors disposed on the grid element.

24. The electrified framework system of claim 23, wherein the second contacting portion includes a receptacle which is connected to wiring of a low voltage power supply.

25. The electrified framework system of claim 23, wherein the second contacting portion includes a receptacle which is connected to wiring of a low voltage device.

26. The electrified framework system of claim 15, wherein the housing conforms substantially to the top portion of the grid element.

27. The electrified framework system of claim 26, wherein a bottom portion of the housing includes a sloping surface whereby dislodgement of the connector is prevented when devices are removed from the openings formed by the grid framework.

28. The electrified framework system of claim 15, wherein the connector comprises a nonconductive housing having opposing legs which straddle the top portion of the grid element, the housing having a means for attaching the conductor to the grid element in such a way that shorting out of the power supply is avoided.

29. The electrified framework system of claim 28, wherein a protrusion extends from each opposing leg, each protrusion being seated in a first keying slot, the keying slot extending through the web portion of the grid element.

30. The electrified framework system of claim 29, wherein the first keying slot is an angled slot.

31. An electrified framework system comprising:

a grid element having a top portion extending in a substantially vertical plane, the grid element includes first and second conductors of opposing polarity, the conductors being disposed on the top portion of the grid element and being positioned on opposing sides of the vertical plane in which the top portion extends substantially; and a connector, the connector being mounted over the top portion of the grid element, the connector having a means for providing a low voltage power connection, wherein the connector includes a first member and a second member, the first member being mounted on the top portion of the grid element and the second member being mounted to a device, wherein the first member includes a nonconductive housing, the nonconductive housing having opposing legs which straddle the top portion of the grid element.

32. The electrified framework system of claim 31, further comprising a conductive clamp positioned over the housing, the clamp having opposing legs which overlap the legs of the housing.

33. The electrified framework system of claim 32, wherein the clamp conforms substantially to the shape of the housing.

34. The electrified framework system of claim 32, wherein each of the opposing legs of the clamp includes a spring contact portion.

35. The electrified framework system of claim 34, wherein the conductive clamp mates with the housing such that a conductive spring contact extends inwardly and through a respective slot in each of the opposing legs of the housing, wherein the conductive springs are in contact with the conductors disposed on the grid element.

36. The electrified framework system of claim 35, wherein the second member includes a nonconductive housing and first and second compliant device contact springs.

37. The electrified framework system of claim 36, wherein the housing of the second member insulates the first and second compliant device contact springs from one another.

38. The electrified framework system of claim 37, wherein the first and second compliant contact springs of the second member are in alignment and mate with an outer surface of one of the opposing legs of the clamp of the first member, the outer surface of the clamp leg providing a mating contact area for the contact springs of the second member, whereby an electrical connection is made between a device to which the second member is mounted and the first and second conductors disposed on the grid element.

39. The electrified framework system of claim 38, wherein the mating contact area can accommodate a wide tolerance range of device positioning in an electrified framework to which the connector is attached.

40. The electrified framework system of claim 38, wherein the first and second compliant contact springs each have a poke-home type of receptacle connected thereto to receive device wiring.

* * * * *